US010466638B2

(12) United States Patent
Yamamoto

(10) Patent No.: US 10,466,638 B2
(45) Date of Patent: Nov. 5, 2019

(54) SHEET STACKING DEVICE, IMAGE FORMING DEVICE, AND POSITION REGULATING MEMBER

(71) Applicant: Konica Minolta, Inc., Chiyoda-ku, Tokyo (JP)

(72) Inventor: Kenichi Yamamoto, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/912,868

(22) Filed: Mar. 6, 2018

(65) Prior Publication Data

US 2018/0275588 A1 Sep. 27, 2018

(30) Foreign Application Priority Data

Mar. 22, 2017 (JP) ..... 2017-056615

(51) Int. Cl.

*B65H 1/26* (2006.01)
*B65H 1/04* (2006.01)
*G03G 15/00* (2006.01)

(52) U.S. Cl.

CPC ..... *G03G 15/6567* (2013.01); *B65H 1/04* (2013.01); *B65H 1/266* (2013.01); *G03G 15/6502* (2013.01); *B65H 2402/5155* (2013.01); *B65H 2403/513* (2013.01); *B65H 2403/53* (2013.01); *B65H 2511/11* (2013.01); *B65H 2511/20* (2013.01)

(58) Field of Classification Search

CPC ..... B65H 1/266; B65H 1/04; B65H 2511/11; B65H 2511/12; B65H 2511/22; B65H 2402/5151; B65H 2402/64

See application file for complete search history.

(56) References Cited

U.S. PATENT DOCUMENTS 7,607,657 B2 * 10/2009 Kawarago ..... B65H 1/266 271/171
8,136,809 B2 * 3/2012 Furusawa ..... B65H 1/266 271/171

(Continued)

FOREIGN PATENT DOCUMENTS

JP 2010-006593 A 1/2010
JP 2011-201703 A 10/2011
WO 5058740 B2 10/2012

*Primary Examiner* — Luis A Gonzalez

(74) *Attorney, Agent, or Firm* — Buchanan Ingersoll & Rooney PC

(57) ABSTRACT

A sheet stacking device including a position regulating member movable in a first direction toward a sheet edge and in a second direction away from the sheet edge, in order to regulate position of the sheet. The position regulating member includes a lock member movable between an engage position and a release position and a lock releaser that moves the lock member from the engage position to the release position. The lock releaser includes a lever member, an upper portion of the lever member including an operation portion, a pivot support that allows the lever member to tilt in the first direction and the second direction, and release mechanisms that move the lock member to the release position when the operation portion is tilted in either direction. Both the release mechanisms are provided on one side of the pivot support in the first direction or the second direction.

18 Claims, 19 Drawing Sheets

(56) References Cited

U.S. PATENT DOCUMENTS

| | | | | |
|---|---|---|---|---|
| 8,882,377 | B2 * | 11/2014 | Kim | B65H 1/266 271/171 |
| 9,027,920 | B2 * | 5/2015 | Sato | B65H 1/04 271/171 |
| 9,260,262 | B2 * | 2/2016 | Matsumoto | B65H 1/266 |
| 9,957,122 | B2 * | 5/2018 | Koga | G03G 21/1695 |
| 2011/0233854 | A1 | 9/2011 | Sunohara | |
| 2017/0313530 | A1 * | 11/2017 | Fuse | B65H 1/266 |
| 2018/0037426 | A1 * | 2/2018 | Hyodo | B65H 1/04 |

* cited by examiner

Y-Y cross section

Z-Z cross section

Y-Y cross section

Z-Z cross section

Y-Y cross section

Z-Z cross section 120
121
123
124
132
133
L1
L2
L3
L4
L4'
α
β
A
B
E1
E2
H1
H2

Lock

Lock release

SHEET STACKING DEVICE, IMAGE FORMING DEVICE, AND POSITION REGULATING MEMBER

This application claims priority to Japanese Patent Application No. 2017-056615 filed Mar. 22, 2017, the contents of which are hereby incorporated herein by reference in their entirety.

BACKGROUND

Technical Field

The present invention relates to sheet stacking devices that stack sheets, image forming devices including a sheet stacking device, and position regulating members in sheet stacking devices.

Related Art

An image forming device such as a printer has a sheet stacking device such as a paper cassette in which sheets are stored in a stack, from which the sheets are sequentially conveyed one by one to a conveyance path for image forming on each sheet conveyed along the conveyance path.

In the sheet stacking device, a position regulating member is typically provided that contacts a conveyance direction upstream end (conveyance direction back end) and/or a width direction side orthogonal to the conveyance direction of a stored sheet, the position regulating member regulating shifting of sheet position towards an upstream side in the conveyance direction and/or in the width direction.

The position regulating member is typically supported to be moveable in the sheet conveyance direction (and/or width direction). For example, when a B5 sheet is stored instead of an A4 size sheet, a user can move the position regulating member from a regulating position corresponding to the A4 size to a regulating position corresponding to the B5 size, allowing storing of different sizes of sheet.

When the position regulating member is moved by a user to a regulating position corresponding to sheet size, a lock mechanism locks the position regulating member to prevent movement from the regulating position.

Various proposals have been made for structures for releasing the lock mechanism, but recently there has been a growing demand for universal design in this technical field.

SUMMARY

The present invention has been made in view of the above circumstances, and an aim of the present invention is to provide a sheet stacking device that achieves universal design and excellent operability, an image forming device including the sheet stacking device, and a position regulating member.

A sheet stacking device pertaining to one aspect of the present invention includes: a stacking unit for stacking sheets; and a position regulating member held in the stacking unit and movable in a first direction toward a stacked sheet edge and in a second direction away from the sheet edge. An abutting member of the position regulating member abuts against the sheet edge to regulate position of the sheet. The position regulating member includes a lock member movable between an engage position engaging with an engaging portion of the stacking unit and a release position releasing engagement, and a lock releaser that moves the lock member from the engage position to the release position. The lock releaser includes a lever member, a pivot support, a first release mechanism, and a second release mechanism. An upper portion of the lever member includes an operation portion operable by a user. The pivot support supports the lever member and allows the lever member to tilt in the first direction and the second direction. The first release mechanism cooperates with the lever member when the operation portion of the lever member is tilted in the first direction, in order to move the lock member to the release position. The second release mechanism cooperates with the lever member when the operation portion of the lever member is tilted in the second direction, in order to move the lock member to the release position. Both the first release mechanism and the second release mechanism are provided on one side of the pivot support in the first direction or the second direction.

An image forming device pertaining to one aspect of the present invention feeds sheets stacked on a stacking unit one by one to a conveyance path and forms an image on a sheet conveyed along the conveyance path. The image forming device includes the stacking unit and a position regulating member held in the stacking unit and movable in a first direction toward a stacked sheet edge and in a second direction away from the sheet edge. An abutting member of the position regulating member abuts against the sheet edge to regulate position of the sheet. The position regulating member includes a lock member movable between an engage position engaging with an engaging portion of the stacking unit and a release position releasing engagement, and a lock releaser that moves the lock member from the engage position to the release position. The lock releaser includes a lever member, a pivot support, a first release mechanism, and a second release mechanism. An upper portion of the lever member includes an operation portion operable by a user. The pivot support supports the lever member and allows the lever member to tilt in the first direction and the second direction. The first release mechanism cooperates with the lever member when the operation portion of the lever member is tilted in the first direction, in order to move the lock member to the release position. The second release mechanism cooperates with the lever member when the operation portion of the lever member is tilted in the second direction, in order to move the lock member to the release position. Both the first release mechanism and the second release mechanism are provided on one side of the pivot support in the first direction or the second direction.

A position regulating member pertaining to one aspect of the present invention is held in a stacking unit of a sheet stacking device and is moved in a first direction toward a stacked sheet edge and in a second direction away from the sheet edge. An abutting member of the position regulating member abuts against the sheet edge to regulate position of the sheet. The position regulating member includes a lock member movable between an engage position engaging with an engaging portion of the stacking unit and a release position releasing engagement, and a lock releaser that moves the lock member from the engage position to the release position. The lock releaser includes a lever member, a pivot support, a first release mechanism, and a second release mechanism. An upper portion of the lever member includes an operation portion operable by a user. The pivot support supports the lever member and allows the lever member to tilt in the first direction and the second direction. The first release mechanism cooperates with the lever member when the operation portion of the lever member is tilted in the first direction, in order to move the lock member to the release position. The second release mechanism cooperates with the lever member when the operation portion of the lever member is tilted in the second direction, in order to move the lock member to the release position. Both the first release mechanism and the second release mechanism are provided on one side of the pivot support in the first direction or the second direction.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the invention. In the drawings.

DETAILED DESCRIPTION

The inventors of the present application designed and prototyped a position restricting member that can be released from locking and be moved in a target direction with use of a single finger, to implement universal design qualities in a sheet stacking device.

Figure 23A:
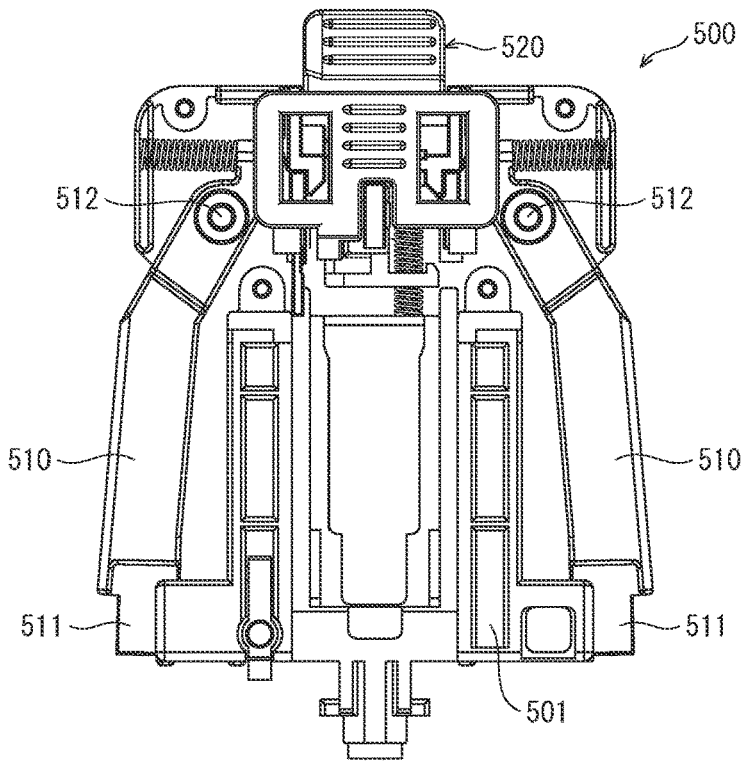
FIG. 23A and FIG. 23B are diagrams illustrating a locked state and an unlocked state of a position regulating member relevant to the background of the present disclosure.
Figure 23B:
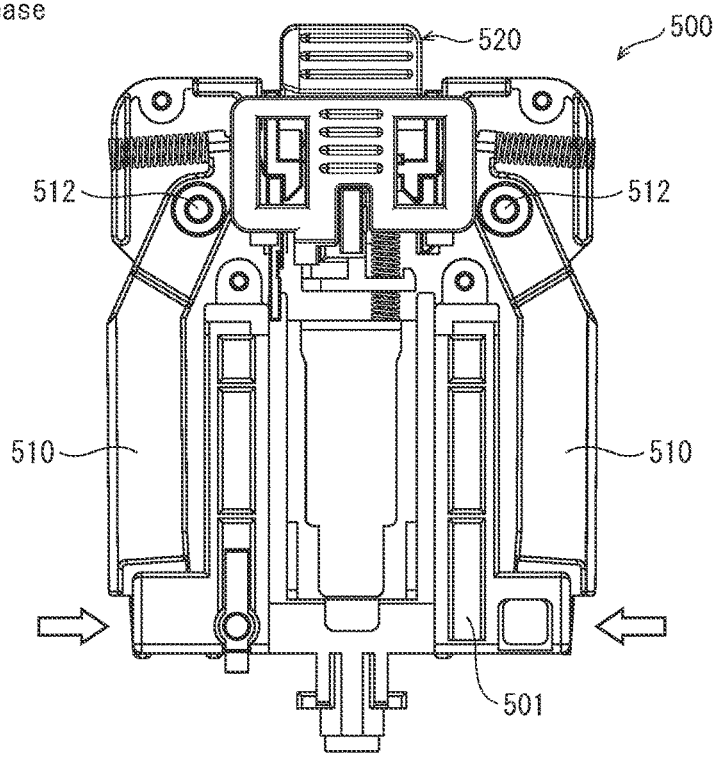

FIG. 23A and FIG. 23B are diagrams in which a configuration is shown of a back surface of a portion (abutting member) that abuts against a sheet of a position regulating member 500 prototyped as described above.

As shown in FIG. 23A and FIG. 23B, a pair of wing-like lock members 510 are attached to left and right side portions of a regulating member main body 501 so as to be able to swing around pivots 512 (the same reference numerals are applied to members that are symmetrical across the drawings; this also applies to other drawings).

On a bottom surface of a paper cassette (not illustrated) is a groove along which a regulating member can slide in a sheet feed direction. On an inner side surface of the groove are lock grooves at positions according to sheet size.

In FIG. 23A, the lock members 510 are shown in a locked state, opening outward. At this time, lock portions 511 of lower ends of the lock members 510 are engaged with lock grooves in the sides of the paper cassette, locking the position regulating member 500 in a position according to sheet size.

In FIG. 23B, the lock members 510 are shown in an unlocked state, in which engagement between the lock groove and the lock portions 511 of the lock members 510 is released.

A user can operate an operation lever 520 to switch the lock members 510 between lock positions and lock release positions.

Figure 24:
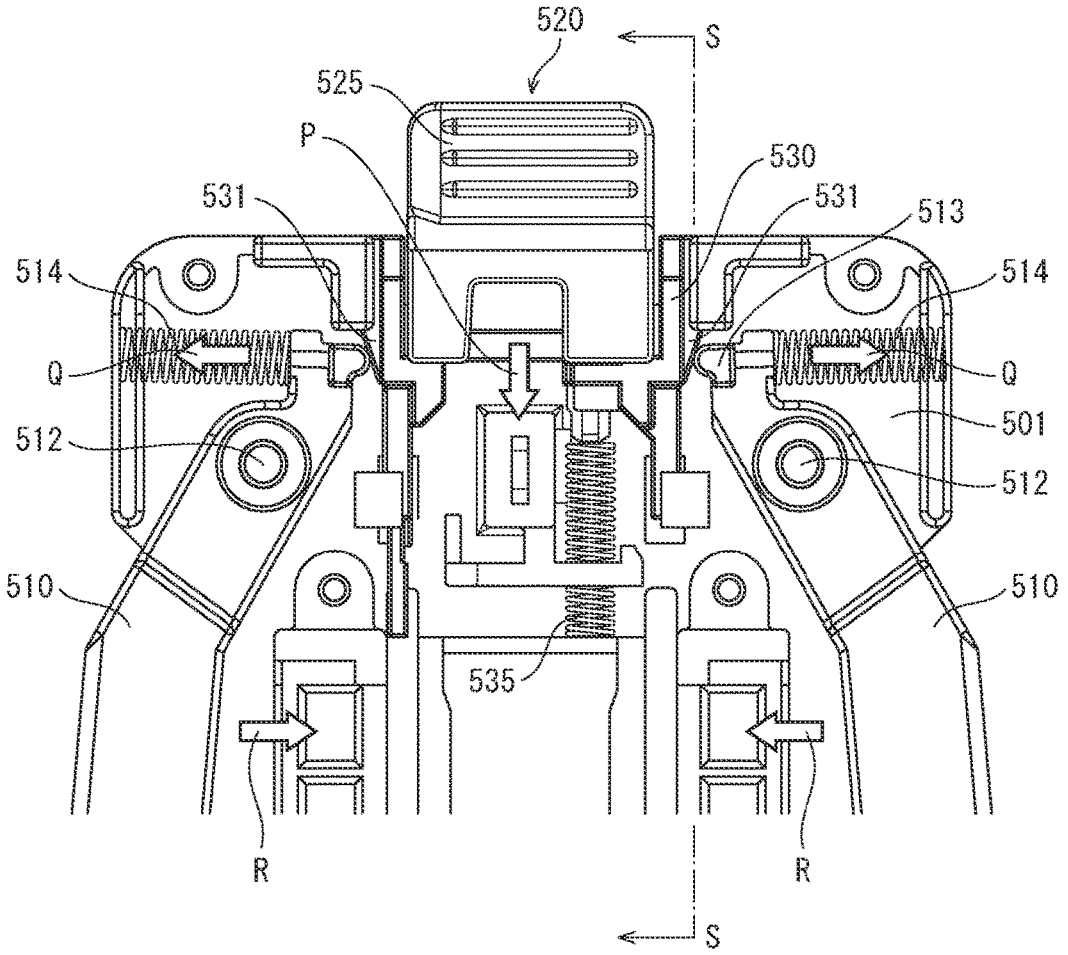
FIG. 24 is a diagram illustrating drive mechanisms of lock members in the position regulating member of FIG. 23A.

In FIG. 24, an upper portion of the position regulating member 500 of FIG. 23A is shown enlarged, and a part of the operation lever 520 is shown removed, in order to facilitate understanding of the configuration for swing motion of the lock members 510.

A link member (movable member) 530 is held to be slidable in a vertical direction along a back surface of the regulating member main body 501, at a substantially central portion in the width direction of an upper portion of the regulating member main body 501.

The link member 530 is biased upward by a compression spring 535 and has inclined portions (tapered portions) 531 at either side.

Abutting portions 513 are on inner side end portions of the lock members 510 above the pivots 512. The abutting portions 513 receive force from compression springs 514, maintaining a state in which the abutting portions 513 abut against an inclined surface (tapered portion surface) of the inclined portions 531 of the link member 530.

According to this configuration, when the link member 530 moves downward (direction P), the inclined portions 531 each exert a component force that pushes a corresponding one of the abutting portions 513 outwards (directions Q), and therefore portions of the lock members 510 below the pivots 512 swing inwards (directions R), releasing locking (FIG. 23B).

This action, among the inclined members and abutting members abutting against the inclined surface of the inclined members, in which one member moves in a first direction, as a result of which other members are moved in the first direction and a second direction different from the first direction, is hereinafter also referred to as a "taper action".

Downward movement of the link member 530 is realized by a user tilting the operation lever 520 in either direction orthogonal to the plane of FIG. 24.

Figure 25A:
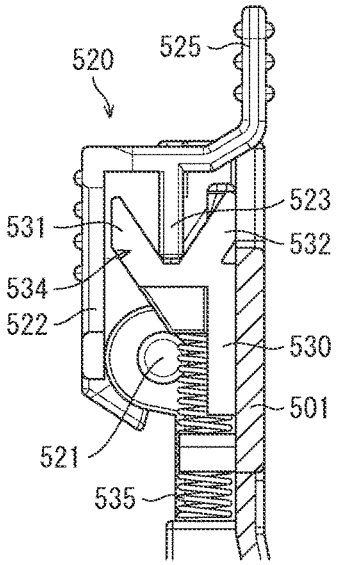
FIG. 25A to FIG. 25C are cross-sections along an S-S line from FIG. 24, illustrating a swing operation of an operation lever.
Figure 25B:
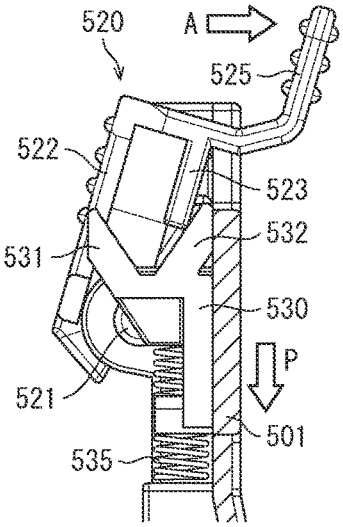
Figure 25C:
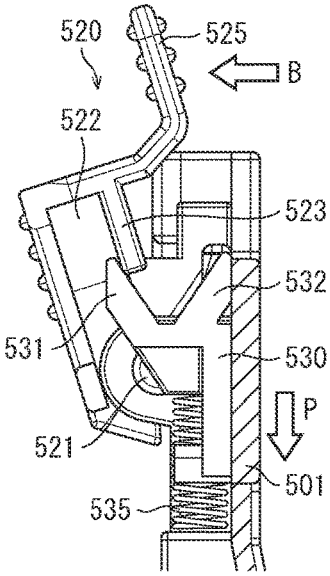

FIG. 25A to FIG. 25C are cross-section diagrams taken along the S-S line in FIG. 24, and show downwards movement of the link member 530 according to swing operation of the operation lever 520.

FIG. 25A is a cross-section diagram of the position regulating member 500 in a locked state.

At an upper portion of the link member 530, an engagement V-shaped portion 534 has an inclined portion 531 and an inclined portion 532 facing each other in a V-shape. An engagement portion 523 of the lever member 522 of the operation lever 520 is interposed in a valley portion of the engagement V-shaped portion 534.

The operation lever 520 is held to be swingable relative to the regulating member main body 501 via a pivot 521. In FIG. 25B, a user pushes an operation portion 525 provided at an upper portion of the operation lever 520 in a direction A, the engagement portion 523 abuts against the inclined surface of the inclined portion 532, and the link member 530 is pushed down according to a taper action. Accordingly, as described with reference to FIG. 24, the lock members 510 move inwards to an unlocked state.

Then the position regulating member 500 moves in the direction A, and when the user removes the finger from the operation portion 525, the operation lever 520 returns to its original position due to action of the compression spring 535 (see FIG. 24) and the lock members 510 return to lock positions due to action of the compression springs 514 (see FIG. 23A).

Similarly, in FIG. 25C, a user pushes the operation portion 525 in a direction B, the link member 530 is pushed down according to a taper action that occurs due to engagement of the engagement portion 523 and the inclined surface of the inclined portion 531, releasing locking and moving the position regulating member 500 in the direction B until the user removes the finger from the operation portion 525, returning the lock members 510 to a lock position.

In this way, the position regulating member 500 is unlocked and moved in a direction by operation of the operation portion 525 with only one finger, and simply removing the finger from the operation portion 525 can return the position regulating member 500 to a locked state, and therefore the position regulating member 500 excels in operability and universal design.

Figure 26A:
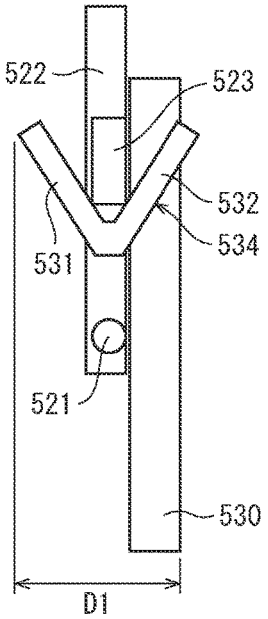
FIG. 26A to FIG. 26C are schematic diagrams corresponding to FIG. 25A to FIG. 25C, for facilitating understanding of a relationship between abutting portions of a lever member and inclined portions of the link member.
Figure 26B:
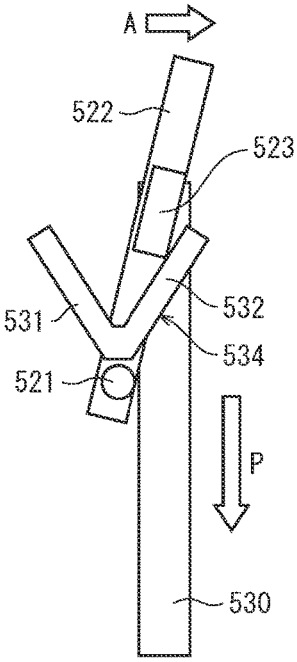
Figure 26C:
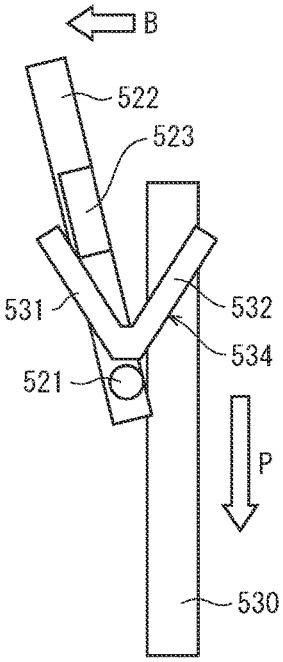

FIG. 26A to FIG. 26C correspond to FIG. 25A to FIG. 25C, and schematically illustrate the lever member 522 and the engagement portion 523, principles of movement of the link member 530 according to a mutual relationship between the link member 530 and the inclined portions 531, 532, and a taper action, in order to facilitate understanding.

However, while there is demand for universal design in the field of sheet feeding, there is also a strong demand for reduction in size of paper feed cassettes and image forming devices as a whole, and therefore a reduction in thickness in the paper feed direction of the position regulating member 500 is sought.

The position regulating member 500, as schematically illustrated in FIG. 26A, includes the inclined portion 531 and the inclined portion 532 facing each other, and therefore the potential for reducing thickness D1 is limited. As a result, it is difficult to reduce the size of a sheet stacking device provided with the position regulating member 500 in the paper feed direction.

The demand described above is not limited to paper cassettes of image forming devices, but is also applicable in general for any sheet stacking device having a position regulating member for regulating position of stored sheets.

Thus, the inventors arrived at an aspect of the present invention with the aim of providing a sheet stacking device, an image forming device including the sheet stacking device, and a position regulating member that allows a reduction in size while also achieving universal design.

Embodiment 1

The following describes at least one embodiment of a sheet stacking, an image forming device, and a regulating member pertaining to the present disclosure, using an example of a tandem-type color printer (hereinafter also referred to as "printer").

(1) Overall Configuration of Printer

Figure 1:
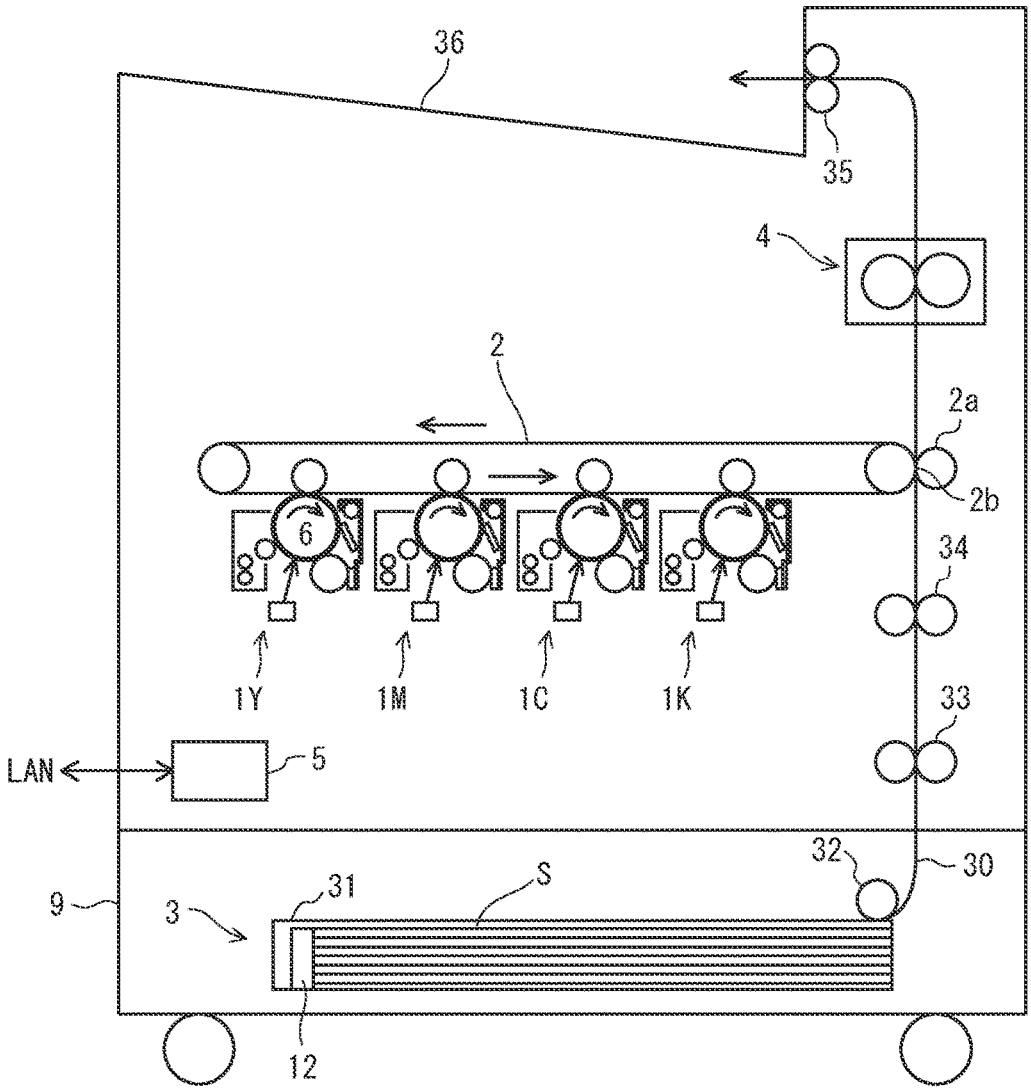
FIG. 1 is a diagram of overall configuration of a printer pertaining to Embodiment 1.

FIG. 1 is a diagram illustrating overall configuration of a printer.

The printer forms images by a known electrophotographic method, and includes imaging units 1Y, 1M, 1C, 1K, an intermediate transfer belt 2, a paper feeder 3, a fixing unit 4, and a controller 5. The printer is connected to a network (for example, a local area network (LAN)), and upon receiving an instruction to execute a print job from an external terminal device (not illustrated), executes yellow (Y), magenta (M), cyan (C), and black (K) color image formation based on the instruction.

The imaging units 1Y to 1K are arranged directly below the intermediate transfer belt 2 along a travel direction of the intermediate transfer belt 2.

The imaging unit 1Y forms a Y toner image on a photoreceptor drum 6, which rotates in a direction indicated by an arrow. The other imaging units 1M, 1C, 1K also form toner images of corresponding colors (M, C, K) on corresponding photoreceptor drums, although in FIG. 1 the reference sign 6 is omitted for these photoreceptor drums.

The paper feeder 3 includes a paper cassette 31, a pick up roller 32, a conveyance roller 33, and a timing roller 34.

The paper cassette 31 is a sheet stacking device in which sheets S are stacked as recording sheets, and is supported by a device body 9 in a way that allows the paper cassette 31 to be pulled out to a front side of the device body 9. When replenishing sheets S to the paper cassette 31, a user can pull out the paper cassette 31 to the front side, store new sheets S in the paper cassette 31, then push the paper cassette 31 towards a device back side in order to return the paper cassette 31 to its original paper feed position.

The pick up roller 32 feeds sheets S from the paper cassette 31 to a conveyance path 30. The conveyance roller 33 conveys sheets S further downstream in a conveyance direction.

The timing roller 34 takes a timing to send on a sheet S conveyed by the conveyance roller 33 to a secondary transfer roller 2*a*.

The fixing unit 4 includes a fixing roller and a pressure roller, and fixes a toner image on a sheet S by application of heat and pressure to a defined fixing temperature.

Based on image data from the external terminal device, the controller 5 causes each of the imaging units 1Y-1K to form a toner image on a corresponding one of the photoreceptor drums 6.

Each toner image on the photoreceptor drums 6 is transferred onto the intermediate transfer belt 2 (this is also referred to as a primary transfer). The primary transfers are executed at staggered timings so the toner images are transferred to the same position on the intermediate transfer belt 2.

The superimposed toner image of each color on the intermediate transfer belt 2 is moved in the travel direction of the intermediate transfer belt 2 to a secondary transfer position 2*b*, where the secondary transfer roller 2*a* is pressed against the intermediate transfer belt 2.

In synchronization with the timing of arrival of the superimposed toner image to the secondary transfer position 2*b*, a sheet S is conveyed from the paper feeder 3 via the timing roller 34, to between the running intermediate transfer belt 2 and the secondary transfer roller 2*a*, and at the secondary transfer position 2*b* the superimposed toner image on the intermediate transfer belt 2 is transferred to the sheet S.

The sheet S that has passed through the secondary transfer point 2*b* is conveyed to the fixing unit 4, where the toner image is fixed to the sheet S by heat and pressure, after which the sheet S is discharged via a discharge roller 35 to be stored on a storage tray 36.

(2) Paper Cassette Configuration

Figure 2:
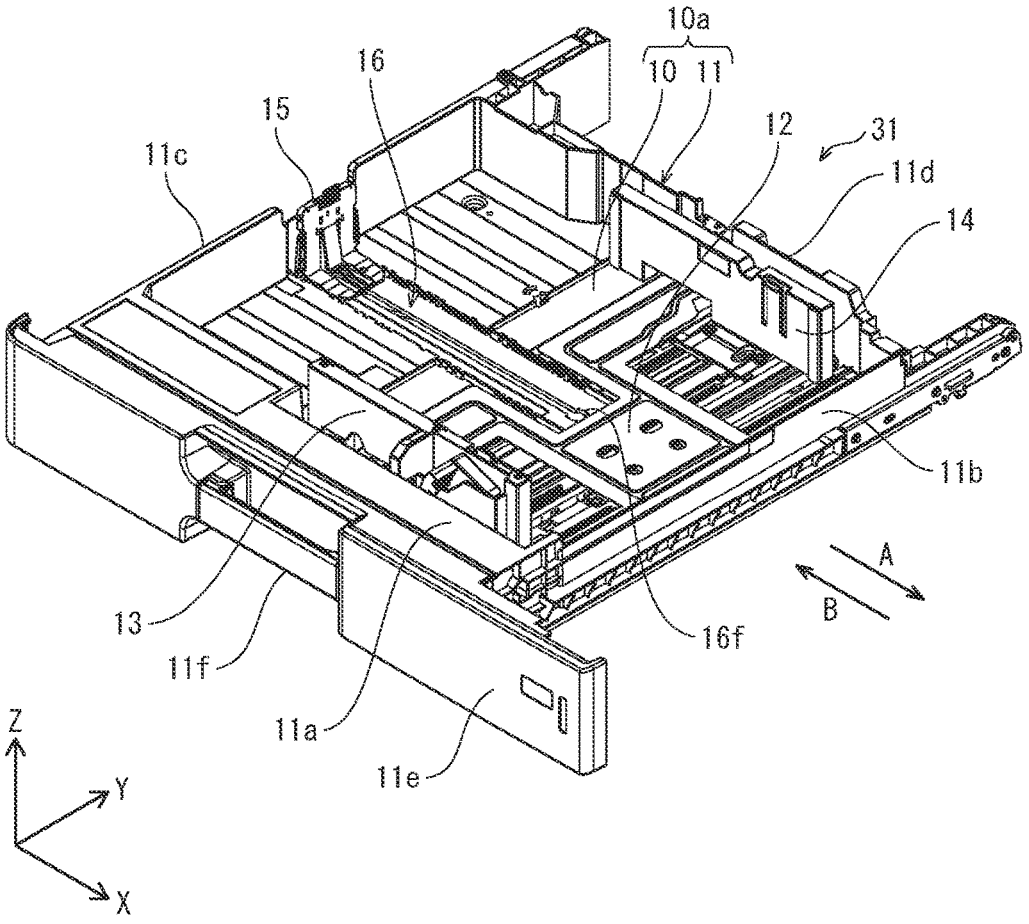
FIG. 2 is a perspective view of a configuration of a paper cassette of the printer.

FIG. 2 is a perspective view of a configuration of the paper cassette 31. In FIG. 2, the paper cassette 31 is illustrated pulled out from the device front side, and a feeding roller 32 and the device body 9 are omitted from the illustration.

In FIG. 2, a direction parallel to a sheet S feed direction (paper feed direction) is an X axis direction, a depth direction is a Y axis direction, and a height direction is a Z axis direction. Further, the paper feed direction is indicated by an arrow A and the opposite direction to the paper feed direction (paper rear end direction) is indicated by an arrow B.

In FIG. 2, the paper cassette 31 includes a substantially rectangular bottom surface 10 and side walls 11 that surround the bottom surface 10. The bottom surface 10 and the side walls 11 constitute a paper stacking unit 10*a* in which sheets S are stored.

The side walls 11 include a front side wall 11*a* at a device front side, a right side wall 11*b*, a left side wall 11*c*, and a rear side wall 11*d*. A cover 11*e* is attached to the front side wall 11*a*, and a handle 11*f* for holding the paper cassette 31 when a user pulls the paper cassette 3 toward the device front side or pushes the paper cassette 31 toward the device rear side is provided on the cover 11*e*.

On the bottom surface 10, a guide region 16 is provided extending along the paper feed direction (arrow A) of the sheets S. A rear end regulating member 15 is slidable along the guide region 16. The rear end regulating member 15 regulates position of an edge (sheet rear edge) in a sheet rear end direction (arrow B) of the sheets S according to size (A4, B5, etc.) of the sheets S stored on the bottom surface 10.

A push-up plate 12 is provided at forward side in the paper feed direction of the bottom surface 10. When the paper cassette 31 is pushed into the device body 9 to a paper feed position, the push-up plate 12 pushes up a sheet portion on a front side of the sheets S in the paper feed direction, and an uppermost sheet of the sheets S is pressed against the feeding roller 32. According to rotation of the feeding roller 32, the uppermost sheet of the sheets S is fed to the conveyance path 30.

Between the front side wall 11*a* and the rear side wall 11*d*, side regulating plates 13, 14 are disposed with a space therebetween in the Y axis direction. The side regulating plates 13, 14 are supported to be slidable in the Y axis direction along guide grooves (not illustrated) provided in the bottom surface 10 that extend in the Y axis direction.

The side regulating plates 13, 14 regulate position of edges (sheet side edges) in the Y axis direction (sheet width direction) of the sheets S according to size of the sheets S stored on the bottom surface 10.

Figure 3:
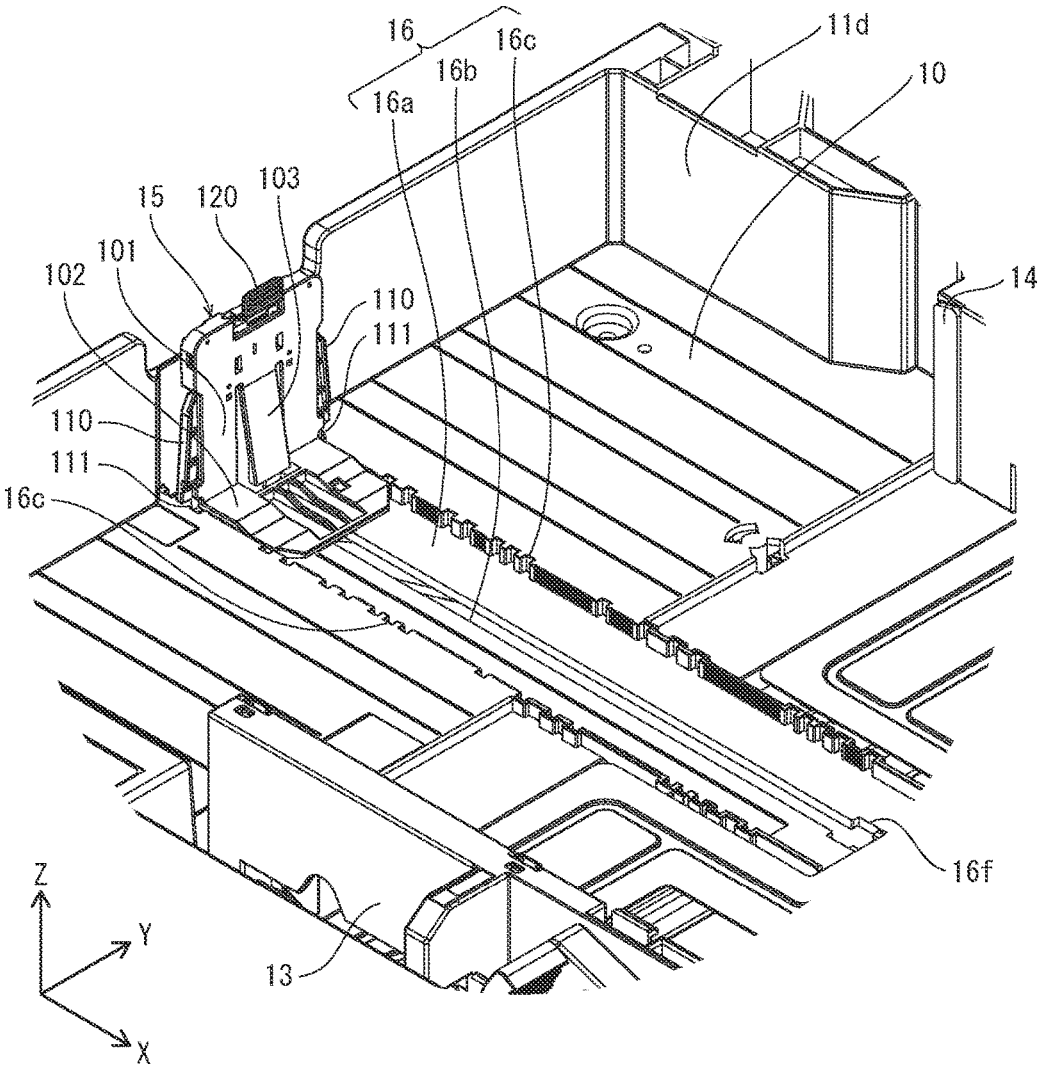
FIG. 3 is a diagram of an enlargement of a guide region of a bottom surface of the paper cassette.

FIG. 3 is a diagram showing an enlargement of the guide region 16.

In FIG. 3, the guide region 16 includes a low floor portion 16*a* that is lower than the bottom surface 10, a groove 16*b* centrally positioned in the low floor portion 16*a*, and a plurality of notches 16*c* provided in steps between the bottom surface 10 and the low floor portion 16*a*.

The low floor portion 16*a* and the groove 16*b* extend along the paper feed direction.

The notches 16*c* each correspond to a length in the paper feed direction of a size of the sheets S.

Lock portions 111 (FIG. 4) of lock members 110 provided to the rear end regulating member 15 each enter (engage with) one of the notches 16*c*, thereby locking the rear end regulating member 15 in position (prohibiting movement). In this sense, the notches 16*c* function as engaging portions that engage with the lock portions 111 of the lock members 110.

(3) Rear End Regulating Member Configuration

Figure 4:
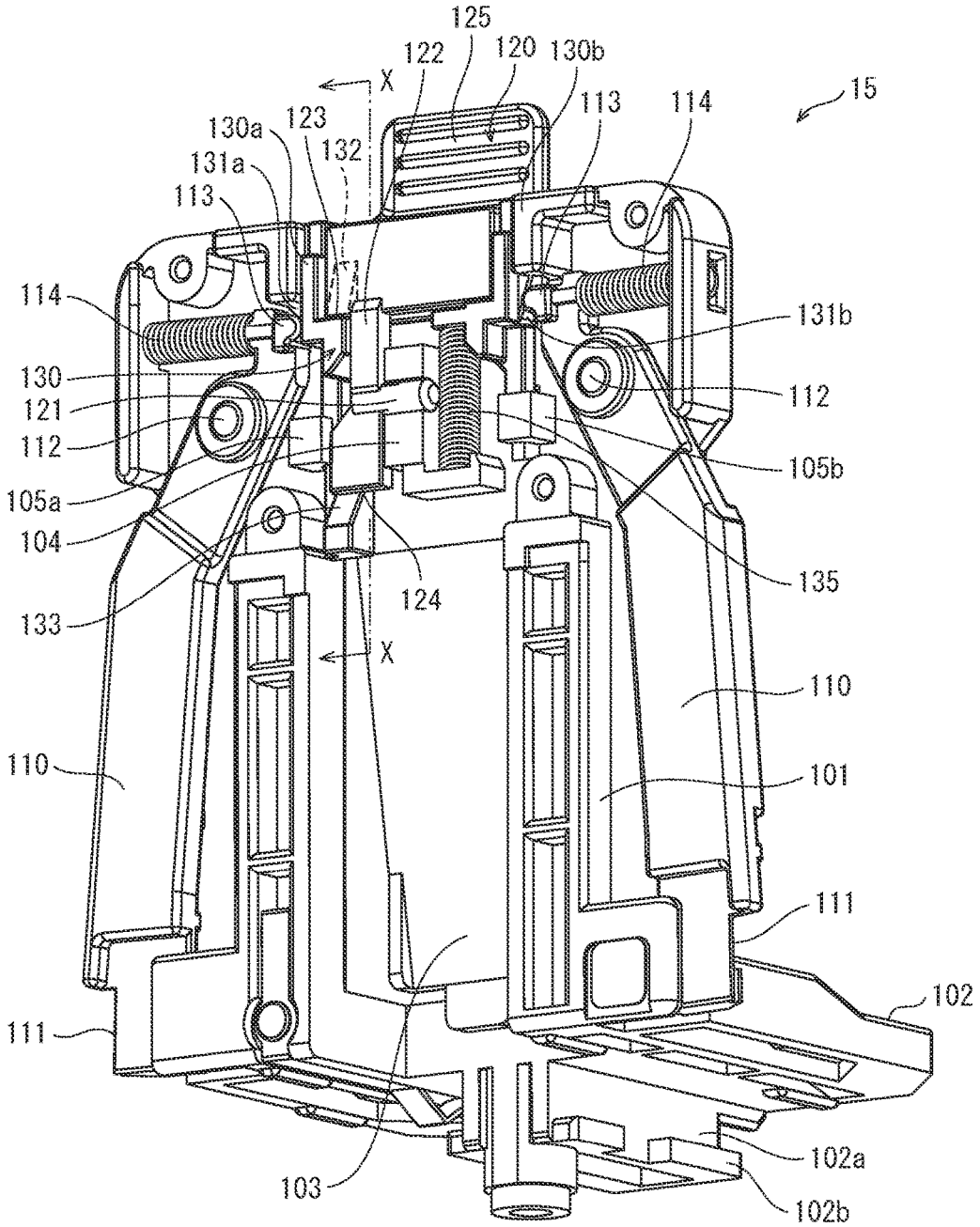
FIG. 4 is a perspective view of a configuration of a rear end regulating member pertaining to Embodiment 1.

FIG. 4 is a perspective view of the rear end regulating member 15 viewed from a rear side (in the X axis direction of FIG. 3). In FIG. 4, a cover member 140 (see exploded view in FIG. 7) is removed to facilitate understanding of internal configuration, and the lock members 110 are shown in a locked state (lock position) opened outward.

In FIG. 4, the rear end regulating member 15 includes a base portion 102 serving as a base, a regulating member main body 101 upright on the base portion 102 for abutting against a sheet rear end, an operation lever 120 for performing a lock release operation of the rear end regulating member 15, and a pair of the lock members 110.

In this example each of these members includes resin, but are not limited to including resin and may include another material such as metal. Further, members may include different materials so that one includes resin and another metal, for example.

The base portion 102 is a base member installed on a stacking surface of the paper cassette 31. A guide member 102*a* that projects downwards is provided on a bottom surface of the base portion 102 and a lower end of the guide member 102*a* has ribs 102*b* that protrude outwards.

The guide member 102*a* of the base portion 102 is inserted to an opening 16*f* provided at a paper feed direction forward end of the groove 16*b* (FIG. 3) of the guide region 16 of the paper cassette 31, then moved backward in a sheet S rear end direction.

As a result, the low floor portion 16*a* of the guide region 16 is sandwiched between the base portion 102 and the ribs 102*b*, preventing the rear end regulating member 15 from coming out of the groove 16*b* of the paper cassette 31.

The regulating member main body (abutting member) 101 is upright in a vertical direction at an end of the base portion 102 opposite a side of the base portion 102 on which a sheet is stacked.

A lower central portion of the regulating member main body 101 is cut out and an elastic piece 103 attached. An upper end of the elastic piece 103 is connected to the regulating member main body 101 and a lower end of the elastic piece 103 is free. The elastic piece 103 is inclined with the lower end further forward in the paper feed direction, contacting the rear end of stored sheets S, and biasing the sheets S in the paper feed direction.

The lock members 110 are vertically elongated wing-like members that are swingably attached to the regulating member main body 101 by pivot supports 112. End portions of the lock members 110 positioned above the pivot supports 112 are biased by compression springs 114 so lower ends of the lock members 110 open outward, that is, towards the lock position.

The lock portions 111 are provided to outer side faces of lower end portions of the lock members 110, for engaging with the lock grooves 16*c* of the paper cassette 31 to lock the rear end regulating member 15.

Figure 7:
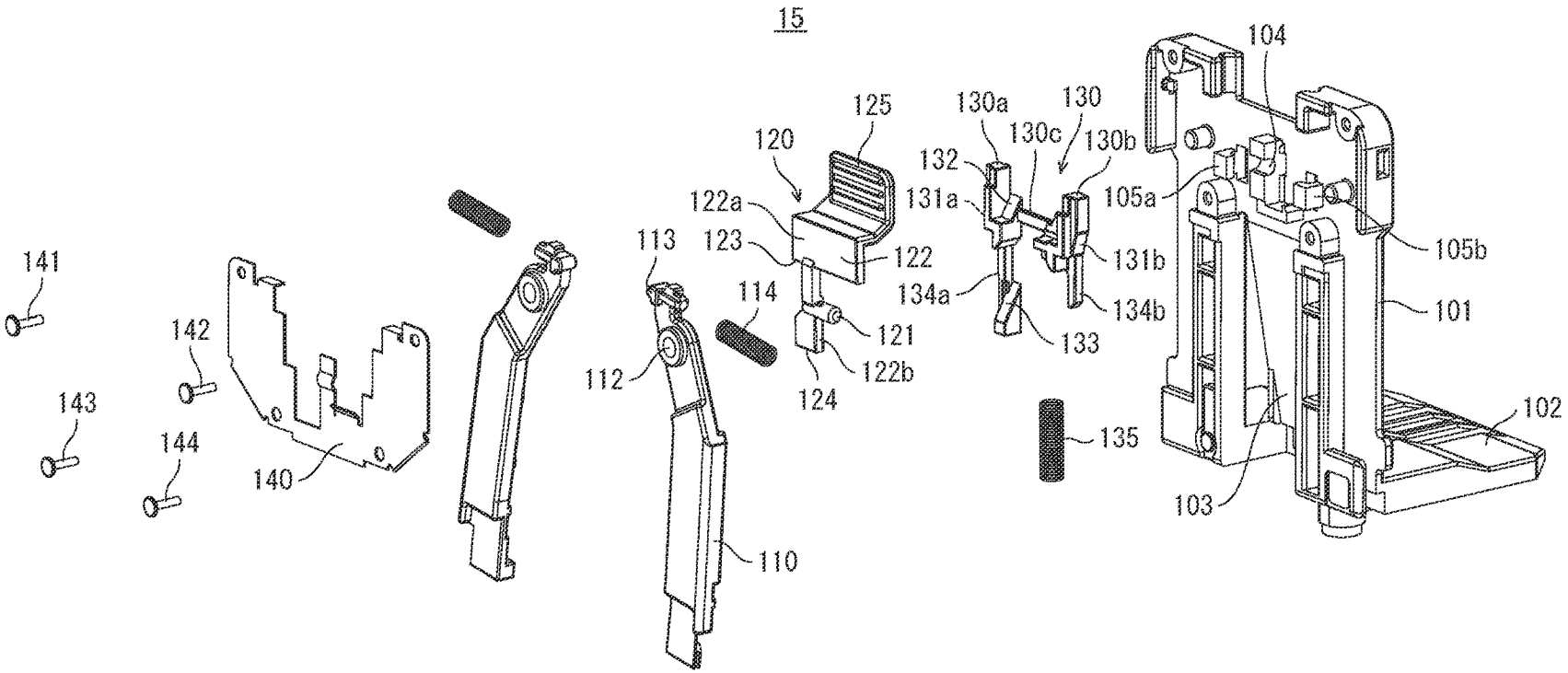
FIG. 7 is an exploded perspective view of the rear end regulating member.

As illustrated in the exploded view of FIG. 7, a link member 130 includes a left vertical member 130*a* and a right vertical member 130*b* connected by a horizontal member 130*c*.

On outer side faces of the left vertical member 130*a* and the right vertical member 130*b*, inclined portions 131*a*, 131*b* are provided symmetrically (see FIG. 4 for the inclined portion 131*b*). Further, inclined portions 132, 133 are provided at two positions, upper and lower, of the left vertical member 130*a*.

The link member 130 is attached to guide members 105*a*, 105*b* provided on a back surface of the regulating member main body 101 so as to be slidable in the vertical direction, and the link member 130 is biased upwards by a compression spring 135.

Further, as illustrated in FIG. 7, the operation lever 120 includes an operation portion 125 as an upper portion for operation by a user and a lever member 122 as a lower portion. The lever member 122 includes a wider first lever portion 122*a* and a narrower second lever portion 122*b*.

The second lever portion 122*b* is provided with a support axis 121. By fitting the support axis 121 into a bearing portion 104 of the regulating member main body 101, the operation lever 120 is attached to the regulating member main body 101 while allowing the operation lever 120 to swing.

Figure 5A:
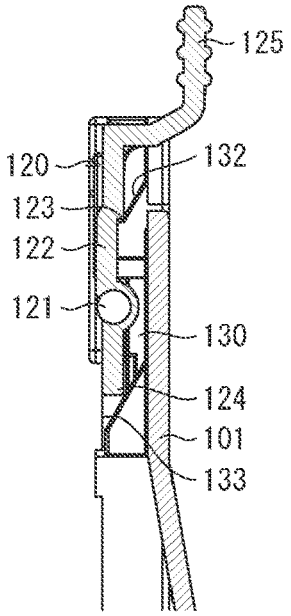
FIG. 5A to FIG. 5C are cross-sections taken along line X-X in FIG. 4, illustrating states of a link member moving downwards according to a swing operation of an operation lever.
Figure 5B:
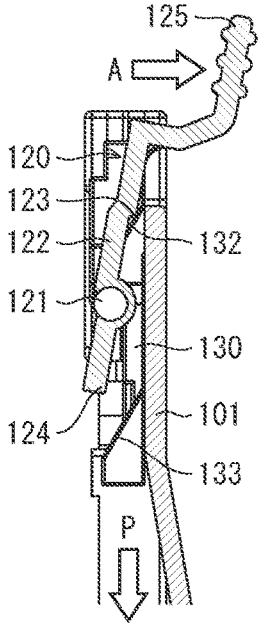
Figure 5C:
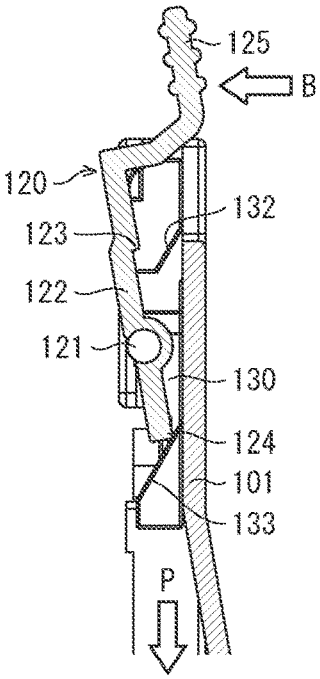

Dimensions of each part of the operation lever 120 are determined such that, when attached, an abutting portion 123 of the first lever portion 122*a* is in contact with an inclined surface of the inclined portion 132 of the link member 130 and an abutting portion 124 of a lower end of the second lever portion 122*b* is in contact with the inclined portion 133 of a lower end of the link member 130 (see FIG. 5A to FIG. 5C).

Returning to FIG. 4, the abutting portions 113 at the upper end portions of the lock members 110 are biased by the compression springs 114 to abut against the inclined portions 131*a*, 131*b* on both sides of the link member 130.

In such a configuration, when the link member 130 moves downward, the inclined portions 131*a*, 131*b* of the link member 130 push the abutting portions 113 outwards according to the taper action, and therefore portions of the lock members 110 below the pivot supports 112 swing inward, releasing the lock.

The configuration of downward movement of the link member 130 that moves the lock members 110 to lock release positions, releasing locking, is the same as the configuration described with reference to FIG. 24. However, the present embodiment has a distinguishing feature in the configuration of pushing down the link member 130 by operating the operation lever 120.

As described above, the operation lever 120 is held and allowed to swing by the bearing portion 104 provided on the regulating member main body 101 via the support axis 121, and according to a swinging motion of the operation lever 120, the link member 130 is moved in the vertical direction to perform a lock operation for locking the rear end regulating member 15 at a sheet rear end regulating position and to perform a release operation to release the locking.

The following describes a movement mechanism of the link member 130 by the operation lever 120.

FIG. 5A is a schematic cross-section view taken along the line X-X in FIG. 4.

As shown in FIG. 5A, when the lock members 110 (FIG. 4) are in the lock position, the operation lever 120 is positioned in a substantially vertical direction.

The inclined portion 132 of the link member 130 is above the support axis 121 and contacts the abutting portion 123 of the lever member 122 of the operation lever 120. On the other hand, the inclined portion 133 of the link member 130 is below the support axis 121 and contacts the abutting portion 124 of the operation lever 120.

Here, as illustrated in FIG. 5B, when a user pushes the operation portion 125 of the operation lever 120 in the direction A, the operation lever 120 swings about the support axis 121 towards the right side of the drawing, and the abutting portion 123 at an upper end of the operation lever 120 pushes against the inclined surface of the inclined portion 132 of the link member 130. A component force occurs at the point of contact, moving the link member 130 downward, and according to a taper action the link member 130 moves downward (direction P) against the biasing force of the compression spring 135 (FIG. 4).

As described above, movement of the link member 130 downwards causes locking by the lock members 110 to be released, and therefore the regulating member main body 101 moves in the direction A, in which the operation portion 125 is pushed, and abuts against a rear end of a sheet stack. Then, if the user removes a finger from the operation portion 125, the link member 130 returns to its start position due to the biasing force of the compression spring 135 (FIG. 5A), and the operation lever 120 also returns to a vertical orientation. The lock member 110 return to lock positions, opening outwards due to the biasing forces of the compression springs 114. Thus, position regulation of a sheet stack is very easily performed.

Further, as illustrated in FIG. 5C, when a user pushes the operation portion 125 of the operation lever 120 in the direction B, the operation lever 120 swings about the support axis 121 towards the left side of the drawing, and the abutting portion 124 at a lower end of the operation lever 120 pushes against the inclined surface of the inclined portion 133 of the link member 130. A component force occurs at the point of contact, moving the link member 130 downward, and according to a taper action the link member 130 moves downward (direction P) against the biasing force of the compression spring 135 (FIG. 4).

Thus, locking by the lock members 110 is released, and therefore the regulating member main body 101 moves in the direction B and separates from a rear end of a sheet stack. Then, if the user removes a finger from the operation portion 125, the lock members 110 return to lock positions, opening outwards.

In FIG. 5A, the rear end regulating member 15 pertaining to at least one embodiment, in comparison with the prototype shown in FIG. 25A, has a considerably reduced thickness that can contribute to an overall size reduction.

Figure 6A:
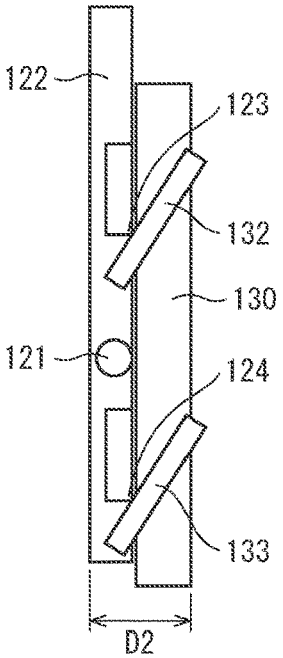
FIG. 6A to FIG. 6C are schematic diagrams corresponding to FIG. 5A to FIG. 5C, for facilitating understanding of the relationship between abutting portions of a lever member and inclined portions of the link member.
Figure 6B:
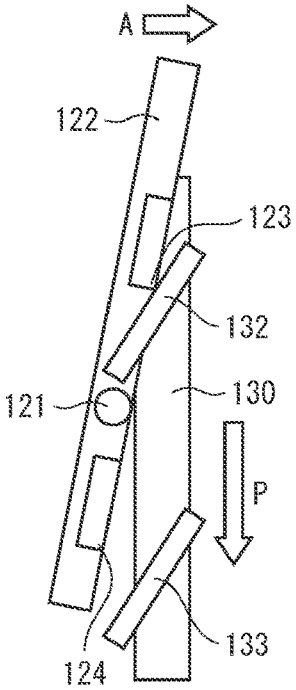
Figure 6C:
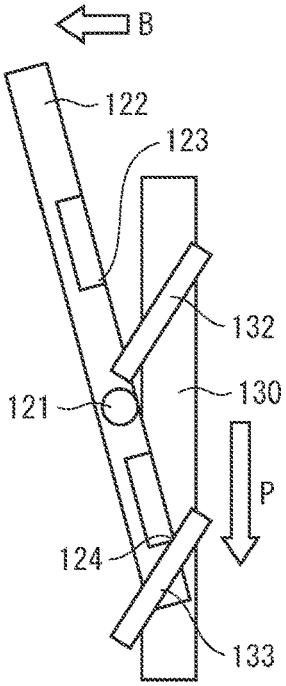

FIG. 6A to 6C schematically show operation principles of FIG. 5A to 5C to facilitate understanding.

As can be understood by comparing FIG. 6A to FIG. 26A, a thickness D2 of the rear end regulating member 15 pertaining to the present embodiment is smaller than the thickness D1 of the prototype in FIG. 26A.

Inclined portions 132 and 133 are disposed on a regulating member main body 101 side (direction A side) of the support axis 121 of the operation lever 120 and the abutting portions 123 and 124 are correspondingly disposed on the operation lever 120, allowing reduction in thickness of the rear end regulating member 15.

FIG. 7 is an exploded diagram of the rear end regulating member 15.

In order to assemble the rear end regulating member 15, leg portions 134*a* and 134*b* of left vertical member 130*a* and right vertical member 130*b* of the link member 130 are attached so as to be slidable up and down along guide members 105*a* and 105*b* of the regulating member main body 101, and the compression spring 135 is attached.

Subsequently, the support axis 121 of the operation lever 120 is fitted into the bearing portion 104 of the regulating member main body 101, the pivot supports 112 of the lock members 110 are attached to the regulating member main body 101, the compression springs 114 are attached, and the cover member 140 is attached to the regulating member main body 101 by using screws 141, 142, 143, 144.

The cover member 140 shields the upper portion of the regulating member main body 101 from the outside, and acts to press components such as the support axis 121 of the operation lever 120 and the pivot supports 112 of the lock members 110 to fulfil a function of fixing positions of the components.

Embodiment 2

According to Embodiment 2, only a mechanism for moving the locking members 110 of the rear end regulating member 15 from lock positions to lock release positions is different, and therefore components common to Embodiment 1 are assigned the same reference signs and are not described below.

According to Embodiment 1, unlocking is performed by tilting the operation lever 120 to move the link member 130 downward. According to the present embodiment, swinging operation of an operation lever 220 directly moves the lower ends of the lock members 110 inwards and releases locking of the lock members 110 without the link member 130 as an intermediary.

Figure 8:
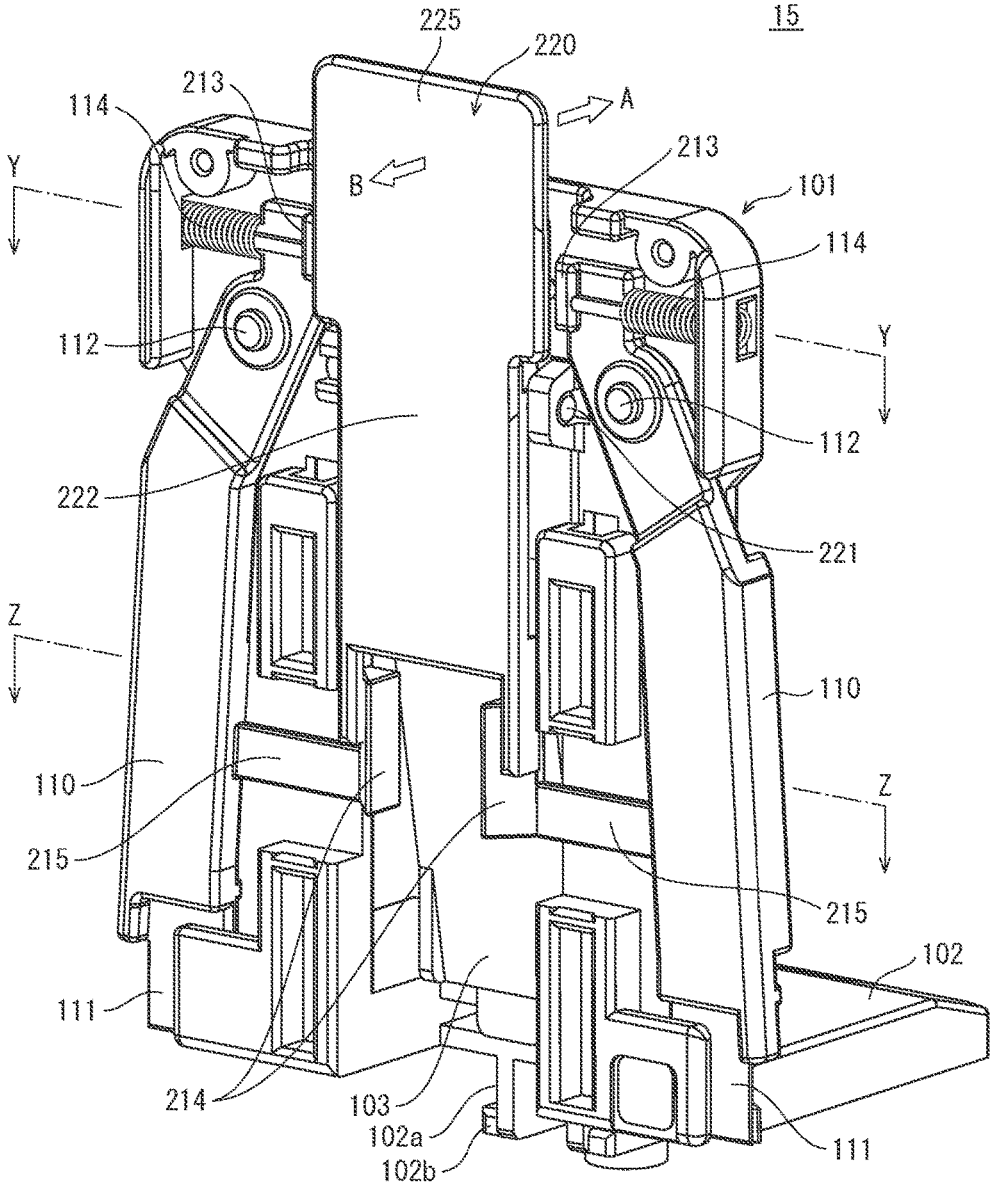
FIG. 8 is a perspective view of a configuration of a rear end regulating member pertaining to Embodiment 2.

FIG. 8 is an external perspective view of the rear end regulating member 15 pertaining to Embodiment 2 viewed from behind. In FIG. 8, the lock members 110 are illustrated in a lock position and the cover member is not illustrated in order to facilitate understanding of internal configuration, as in FIG. 4.

The operation lever 220 is swingably attached to the regulating member main body 101 via a support axis 221, and when an operation portion 225 is pushed in the direction A or the direction B, the lock members 110 move to lock release positions.

Figure 9:
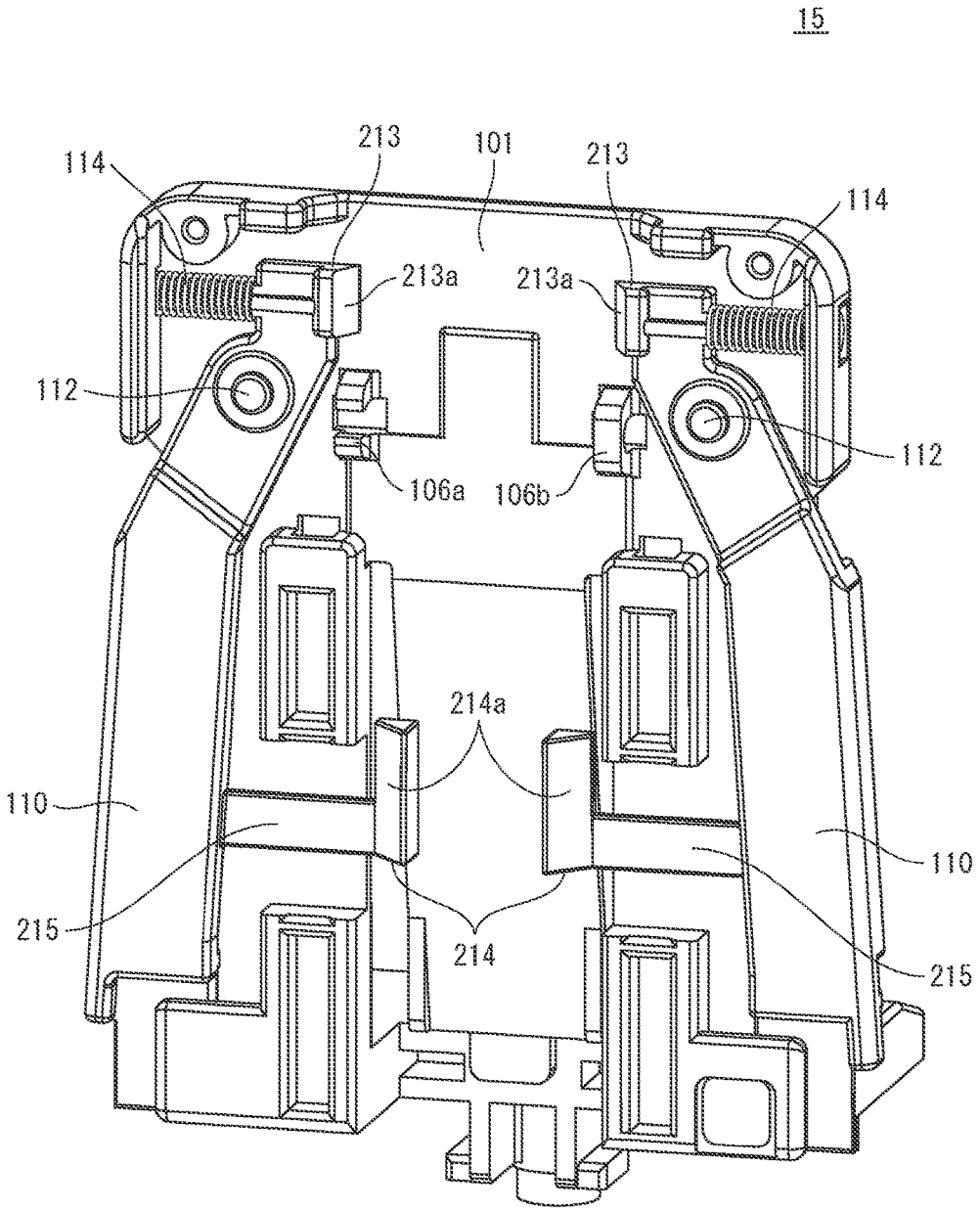
FIG. 9 is a diagram illustrating a state of the rear end regulating member of FIG. 8 in which an operation lever is removed.

FIG. 9 is a view illustrating a back surface of the regulating member main body 101 of the rear end regulating member 15 in FIG. 8 with the operation lever 220 removed.

In FIG. 9, inclined portions 213 are present on inner sides of upper ends of the lock members 110. Inclined surfaces 213*a* of the inclined portions 213 are inclined in a direction away from the regulating member main body 101, such that a space between the inclined surfaces 213*a* increases in the direction away from the regulating member main body 101 (see FIG. 11A).

Arms 215 are provided to lower portions of the lock members 110, each arm extending from the lock members 110 inwards in a substantially horizontal direction with inclined portions 214 present at end portions of the arms 215.

Figure 11A:
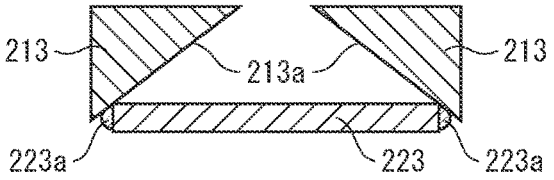
FIG. 11A and FIG. 11B are schematic diagrams illustrating a Y-Y cross-section and a Z-Z cross-section, respectively, from FIG. 8.
Figure 11B:
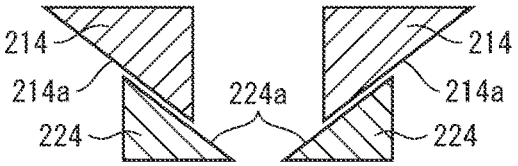

Inclined surfaces 214*a* of the inclined portions 214 are inclined such that they are closer to each other the further they are away from the regulating member main body 101 (see FIG. 11B).

Figure 10:
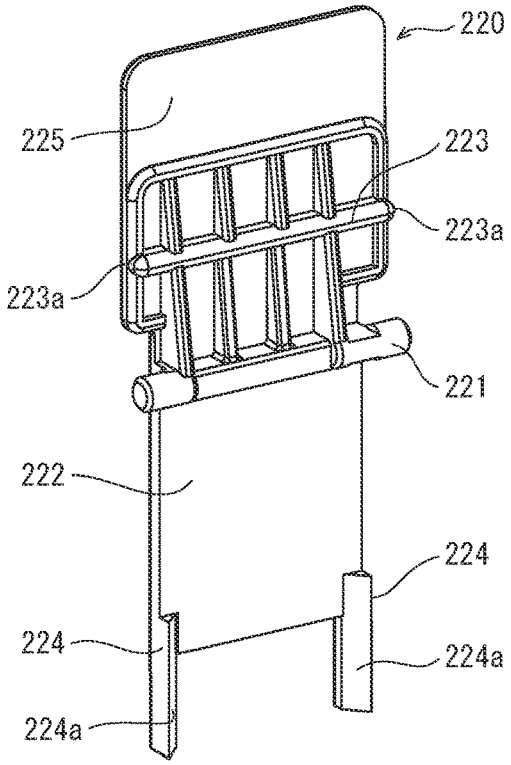
FIG. 10 is a perspective view of the operation lever viewed from a back surface (surface facing a regulating member main body).

FIG. 10 is a diagram of the operation lever 220 viewed from behind (a face that faces the regulating member main body 101).

In FIG. 10, the operation lever 220 includes an upper operation portion 225 and a lower lever member 222. The support axis 221 is formed in a horizontal direction, substantially centrally in a vertical direction of the operation lever 220, and an engaging bar 223 parallel with the support axis 221 is formed above the support axis 221.

Further, a pair of leg portions 224 are provided vertically below the support axis 221 of the lever member 222. Inclined surfaces 224*a* are formed on inner sides of the leg portions 224, inclined in substantially the same direction as the inclined surfaces 214*a* (FIG. 9) of the inclined portions 214 of the lock members 110 (see FIG. 11B).

The support axis 221 of the operation lever 220 is swingably attached to bearing portions 106*a*, 106*b* (FIG. 9) on the regulating member main body 101, in a state as shown in FIG. 8.

FIG. 11A is a cross section taken along the line Y-Y ("Y-Y cross section") in FIG. 8, schematically illustrating an engaged state of the inclined portions 213 of the lock members 110 and the engaging bar 223 of the operation lever 220; and FIG. 11B is a cross section taken along the line Z-Z ("Z-Z cross section") in FIG. 8, schematically illustrating an engaged state of the inclined portions 214 of the lock members 110 and the leg portions 224 of the operation lever 220.

When the lock members 110 are in a lock position as shown in FIG. 8, the operation lever 220 is substantially parallel to the regulating member main body 101, and as shown in FIG. 11A and FIG. 11B, both ends 223*a* of the engaging bar 223 of the operation lever 220 are in contact with the inclined surfaces 213*a* of the inclined portions 213 of the lock members 110, and the inclined surfaces 224*a* of the leg portions 224 of the operation lever 220 are in contact with the inclined surfaces 214*a* of the inclined portions 214 of the lock members 110.

Figure 12:
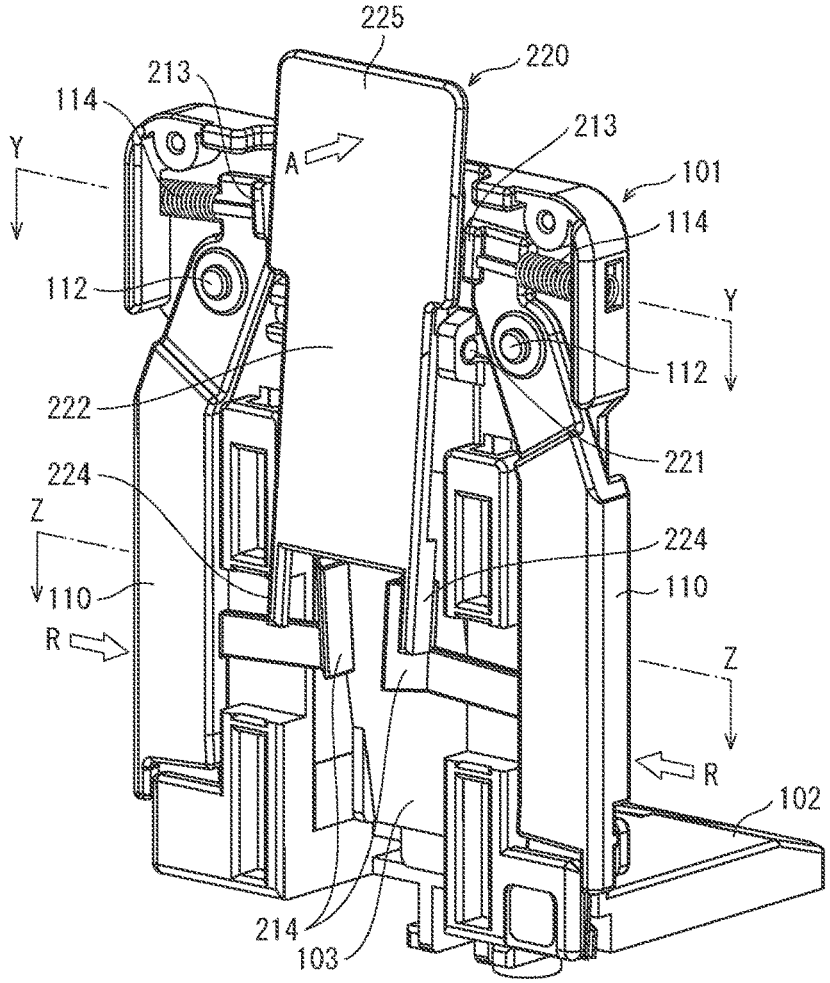
FIG. 12 is a perspective view showing a state of the rear end regulating member when the operation lever is tilted in a direction A.

As shown in FIG. 12, when a user uses a finger to push the operation portion 225 of the operation lever 220 in the direction A to move the rear end regulating member 15 in a sheet direction, the operation lever 220 tilts in the direction A.

Figure 13A:
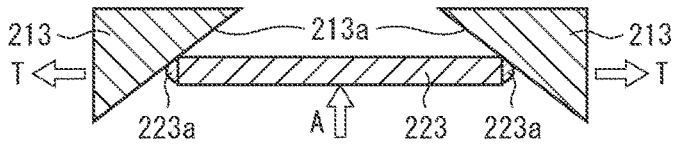
FIG. 13A and FIG. 13B are schematic diagrams illustrating a Y-Y cross-section and a Z-Z cross-section, respectively, from FIG. 12.
Figure 13B:
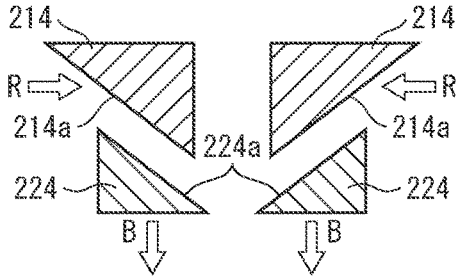

FIG. 13A and FIG. 13B show engagement states of components in the Y-Y cross section and the Z-Z cross section of FIG. 12, respectively.

When the operation lever 220 is tilted in the direction A, both end portions 223*a* of the engaging bar 223 of the operation lever 220 push the inclined surfaces 213*a* of the inclined portions 213 of the lock members 110 in an outwards direction (direction T), as illustrated in FIG. 13A.

On the other hand, the lower portion of the operation lever 220 moves away from the regulating member main body 101, and therefore the inclined surfaces 214*a* of the inclined portions 214 of the lock members move apart from the inclined surfaces 224*a* of the leg portions 224 of the operation lever 220, as illustrated in FIG. 13B.

Thus, lower portions of the lock members 110 move in the directions R, thereby establishing a lock release state, and the rear end regulating member 15 slides and moves in the direction A.

When a user removes a finger from the operation portion 225, lower portions of the lock members 110 move outwards due to biasing forces of the compression springs 114 (FIG. 12), moving to the lock position, and accordingly the operation lever 220 returns to an initial position as illustrated in FIG. 8.

Figure 14:
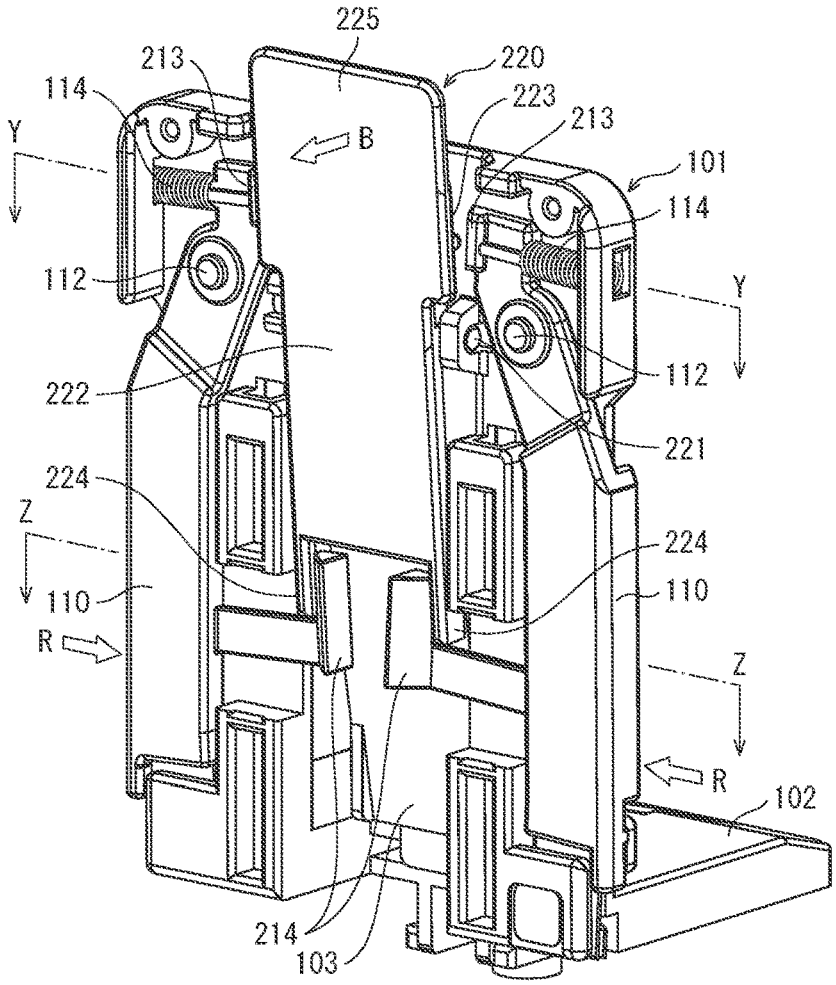
FIG. 14 is a perspective view showing a state of the rear end regulating member when the operation lever is tilted in a direction B.

FIG. 14 illustrates a situation in which the operation portion 225 of the operation lever 220 of the rear end regulating member 15 is pushed in the direction B.

Figure 15A:
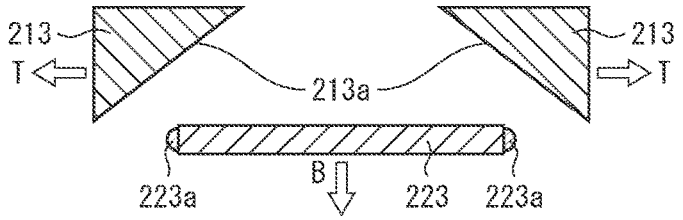
FIG. 15A and FIG. 15B are schematic diagrams illustrating a Y-Y cross-section and a Z-Z cross-section, respectively, from FIG. 14.
Figure 15B:
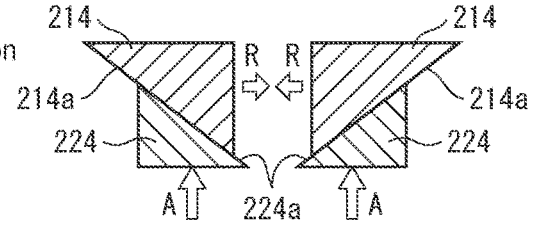

In this situation, as illustrated in FIG. 15A, the engaging bar 223 of the operation lever 220 moves away from the inclined portions 213 of the lock members 110, but the leg portions 224 of the operation lever 220 move in the direction A and the inclined surfaces 224*a* push against the inclined surfaces 214*a* of the inclined portions 214 of the lock members 110. The resulting taper action causes lower portions of the lock members 110 to move inwards (directions R) to lock release positions.

As described above, according to Embodiment 2, by merely pushing the operation portion 225 in a desired direction of movement of the rear end regulating member 15, a user can release locking and move the rear end regulating member 15 using one finger, and by removing the finger a lock state is automatically set and position of the rear end regulating member 15 is fixed. Thus, universal design is excellent and thickness of a vertical portion of the rear end regulating member 15 is made sufficiently smaller than the prototype illustrated in FIG. 23A-26C, which can contribute to overall size reduction of a paper cassette.

Further, when compared to Embodiment 1, according to Embodiment 2 swinging action of the operation lever 220 directly moves the lock members 110 between lock positions and lock release positions, making the link member 130 unnecessary, which is beneficial in terms of cost.

According to both Embodiment 1 and Embodiment 2, the lock members 110 are biased by the compression springs 114 into a lock state, and therefore a user can intuitively cause an unlocked state by, for example, pinching the lock members 110 between thumb and index finger, which provides excellent user friendliness.

<Modifications>

Although the present invention is described herein with reference to embodiments, the present invention is of course no limited to the embodiments described, and includes the following modifications.

(1) According to Embodiment 1, in order to improve ease of use, a configuration is described in which lock release is possible by tilting the operation lever 120 by substantially the same angle in the direction A and the direction B.

Figures 16A, 16B, 16C:
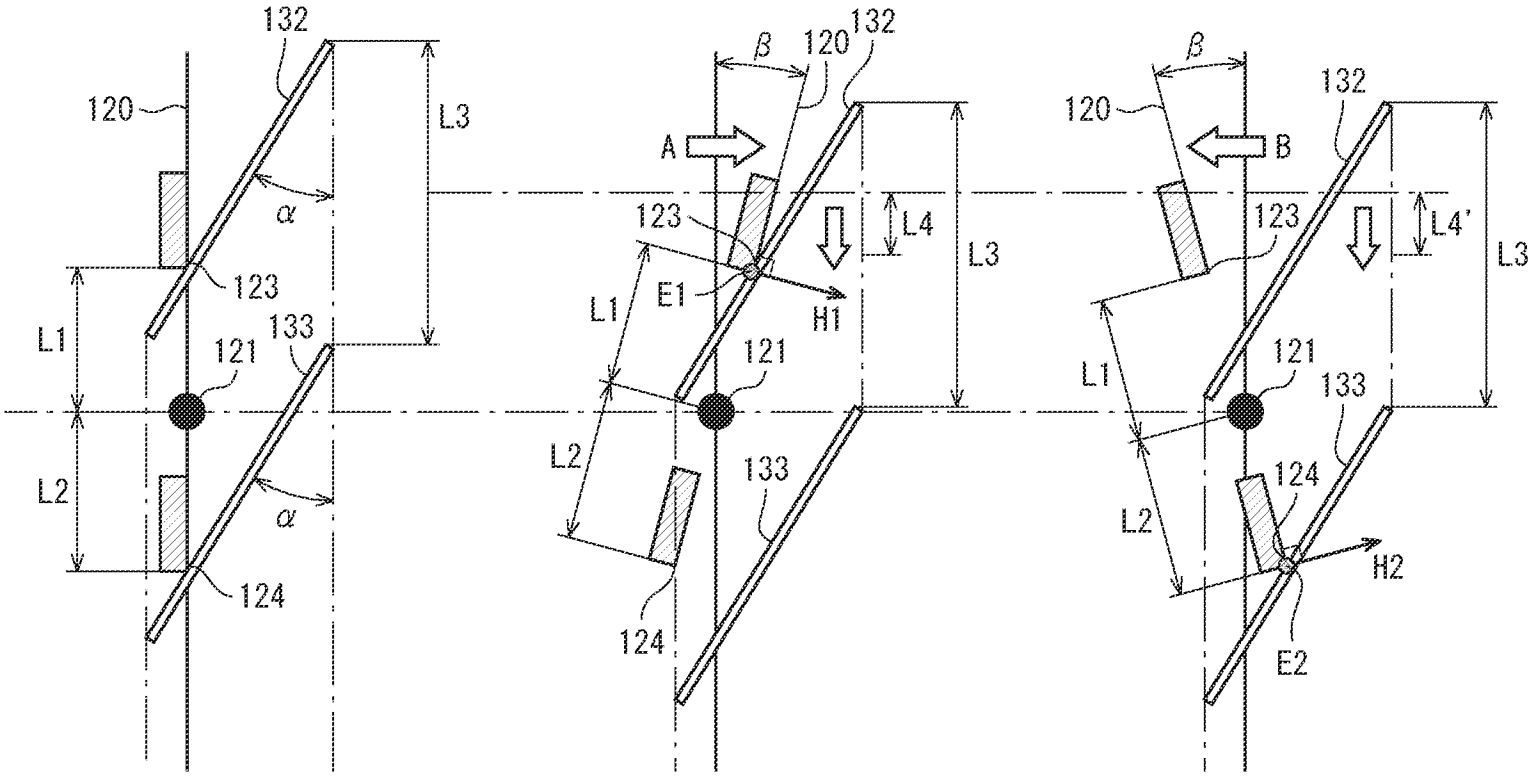
FIG. 16A to FIG. 16C are diagrams illustrating a relationship between position of a pivot of abutting portions of the operation lever and movement distance of the link member for the rear end regulating member pertaining to Embodiment 1.

FIG. 16A-16C illustrate a configuration example of a moving mechanism of a link member of a rear end regulating member for realizing such an operation by schematically illustrating arrangement of components of FIG. 6A-6C.

As illustrated in FIG. 16A-16C, inclined surfaces of the inclined portions 132, 133 provided to the link member 130 (omitted from FIG. 16A-16C for simplicity, see FIGS. 6A-6C) are parallel, and form an angle $\alpha$ with the vertical direction.

The abutting portions 123, 124 of the operation lever 120 that abut against the inclined portions 132, 133 are disposed at distances L1, L2 from the rotation center of the support axis 121.

As illustrated in FIG. 16B, when the operation lever 120 is tilted in the direction A, the abutting portions 123 draw a locus of clockwise rotation and abut against the inclined portions 132 to push the link member 130 (not illustrated) down by a distance L4, releasing locking of the lock members 110.

On the other hand, as illustrated in FIG. 16C, when the operation lever 120 is tilted in the direction B, the abutting portions 124 draw a locus of anticlockwise rotation and abut against the inclined portions 133 to push the link member 130 (not illustrated) down by a distance L4', releasing locking of the lock members 110.

In this way, when the operation lever 120 tilts in the direction A, at a contact position E1 between the abutting portions 123 and the inclined portions 132, the operation lever 120 is pushed slightly downward in a direction H1, which effectively pushes down the inclined portions 132, but when the operation lever 120 tilts in the direction B, at a contact position E2 between the abutting portions 124 and the inclined portions 133, the operation lever 120 is pushed slightly upwards in a direction H2, meaning that when a tilt angle of the operation lever 120 is the same, if L1=L2, the amount L4' of downward push of the inclined portions 133 is smaller than the amount L4 of downward push in the case of FIG. 16B.

According to the present modification, the distance L2 is made longer than the distance L1 by a defined amount, in order that a movement amount of the abutting portions 124 when swinging in the direction B is greater than a movement amount of the abutting portions 123, in order that the amounts L4 and L4' are made substantially equal.

Specific lengths for L1 and L2 can easily be calculated by a person having ordinary skill in the art according to design specifications.

As a specific example, when L1=20 mm, L2=23.2 mm, $\alpha$=30°, $\beta$=15°, and L3=43.2 mm, L4 is equal to 9.647 mm and L4' is equal to 9.61 mm, achieving substantially equal values.

When a user moves the rear end regulating member 15 in the direction A or the direction B, the user can feel that locking can be released by tilting the operation portion 125 by the same angle $\theta$, and therefore excellent user friendliness is achieved.

This configuration can also be applied to the rear end regulating member 15 pertaining to Embodiment 2.

(2) According to Modification (1), in order to make the amount the link member 130 is pushed down substantially equal while making the tilt angle of the operation lever 120 equal in both the direction A and the direction B, the distance L2 from the abutting portions 124 to a rotation center of the support axis 121 is made longer than the distance L1 from the abutting portions 123 to the rotation center of the support axis 121, but even when L2=L1, an angle between the inclined surfaces of the inclined portions 133 provided to the link member 130 (see FIGS. 6A-6C) and the vertical direction can be made smaller than an angle between the inclined surfaces of the inclined portions 132 and the vertical direction by a defined amount, thereby substantially equalizing movement amount of the link member 130 while equalizing tilt angle of the operation lever 120.

FIGS. 17A-17D schematically illustrate an example of the present modification.

As illustrated in FIGS. 17A-17D, between inclined surfaces of the inclined portions 132 provided to the link member 130 (FIGS. 6A-6C) and the vertical direction is an angle α, and between inclined surfaces of the inclined portions 133 and the vertical direction is an angle γ that is smaller than the angle α.

The abutting portions 123, 124 of the operation lever 120 that abut against the inclined portions 132, 133 are disposed at a distance L1 from the rotation center of the support axis 121.

Figure 17A:
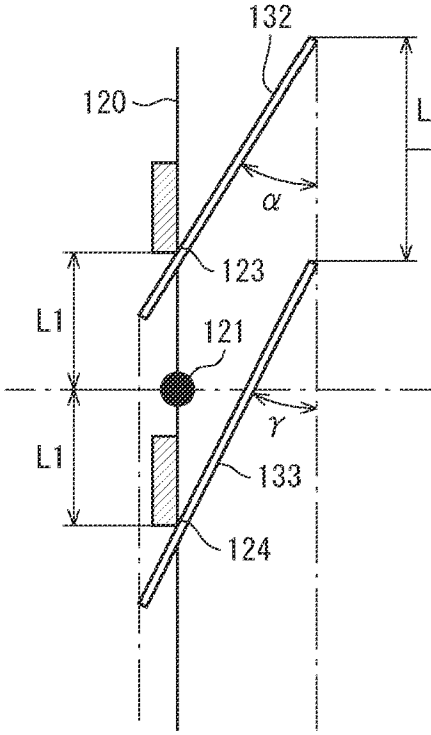
FIG. 17A to FIG. 17D are diagrams illustrating a relationship between differences in inclination angles of inclined portions of the link member and movement distance of the link member for the rear end regulating member pertaining to Embodiment 1.
Figure 17B:
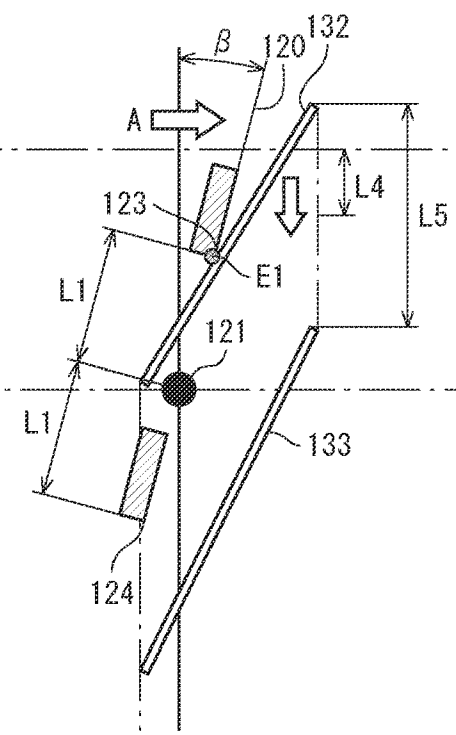

As in FIG. 16B, when the operation lever 120 is tilted in the direction A, the abutting portions 123 draw a locus of clockwise rotation, and therefore a contact portion with the inclined portions 132 moves downwards while pushing the link member 130 (not illustrated) down by the distance L4, as illustrated in FIG. 17B.

Figure 17C:
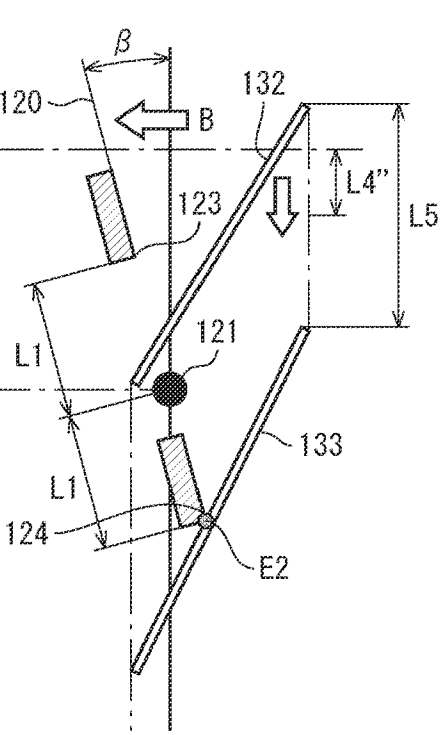

As illustrated in FIG. 17C, when the operation lever 120 is tilted in the direction B, the abutting portions 123 draw a locus of anticlockwise rotation, and therefore contacts the inclined surfaces of the inclined portions 133 and moves them downwards, but according to the present example the abutting portions 123, 124 of the operation lever 120 are disposed at an equal distance L1 from the center of the support axis 121, and therefore if the angles of the inclined portions 132 and the inclined portions 133 were equal, the direction of forces acting on the inclined portions 133 by the abutting portions 124 would be slightly upwards of horizontal, and the amount of pressing on the link member 130 would be smaller than in FIG. 17B, as explained with reference to FIG. 16A-16C.

Figure 17D:
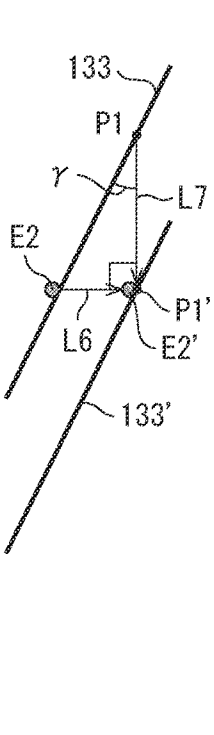

However, as schematically shown in FIG. 17D, when the inclined portions 133 are pushed horizontally at contact position E2 by a distance L6, a point P1 on the inclined portions 133 is displaced downwards by taper action to a point P1' by a distance L7, where L7=L6/tan γ, and therefore the smaller γ is, the larger the distance L7 becomes.

According to the present modification, setting the angle γ of the inclined portions 133 to be smaller than the angle α of the inclined portions 132 by a defined amount causes the amount of pushing down of the inclined portions 133 due to movement of the abutting portions 124 to be equal to the amount of pushing down of the inclined portions 132 due to movement of the abutting portions 123, with respect to an equal angle β of the operation lever 120.

As an example, when L1=20 mm, α=30°, γ=26.6°, L3=34.7 mm, and =15°, L4 is equal to 9.647 mm and L4" is equal to 9.655 mm, achieving substantially equal values.

This configuration can also be applied to the rear end regulating member 15 pertaining to Embodiment 2.

(3) From another perspective, in order to pursue user-friendliness, it may be considered that a difference in force required to releasing locking when pushing the operation portion 125 in the direction A and the direction B is preferably as small as possible.

From this perspective, for example, in the case of FIG. 16A-16C, contrary to Modification (1), L2 is made shorter than L1 by a defined amount, and in the case of FIG. 17A-17D, contrary to Modification (2), the angle γ of the inclined portions 133 is made larger than the angle α of the inclined portions 132 by a defined amount. Specific values can be reached by experimentation or calculation by a person having ordinary skill in the art.

(4) According to Embodiment 1, as schematically illustrated in FIGS. 6A-6C, engagement between the abutting portions 123, 124 of the operation lever 120 and the inclined portions 132, 133 of the link member 130 and the resulting taper action converts a swinging operation of the operation lever 120 to a downwards push operation of the link member 130 (hereinafter, this mechanism is also referred to as "link member push mechanism"), which releases locking by the lock members 110, but configuration of the link member push mechanism is of course not limited to the configuration illustrated in FIGS. 6A-6C, and includes various modifications.

The following describes representative modifications of the link member push mechanism with reference to schematic diagrams.

Figure 18A:
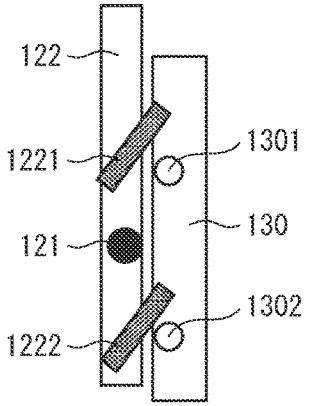
FIG. 18A to FIG. 18C are schematic diagrams illustrating configuration of Modification 1 of a link member push mechanism.
Figure 18B:
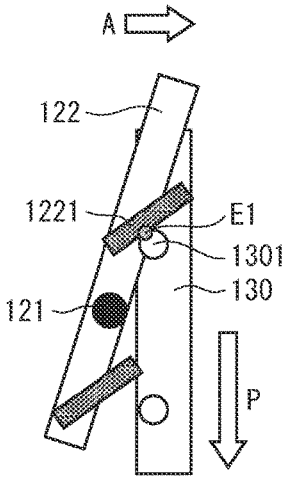
Figure 18C:
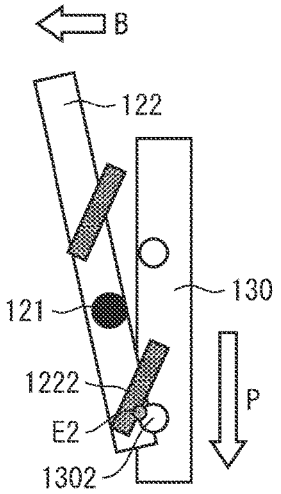

(4-1) FIG. 18A-18C illustrate a first modification of the link member push mechanism.

In FIG. 18A, inclined portions 1221, 1222 are provided on the lever member 122, and pin-shaped abutting portions 1301, 1302 are provided on the link member 130.

According to this configuration, as illustrated in FIG. 18B, when the lever member 122 is tilted in the direction A, the inclined portion 1221 and the abutting portion 1301 abut at point E1, and according to taper action the link member 130 moves downwards (direction P). Further, as illustrated in FIG. 18C, when the lever member 122 is tilted in the direction B, the inclined portion 1222 and the abutting portion 1302 abut at point E2, and according to taper action the link member 130 moves downwards (direction P).

Figure 19A:
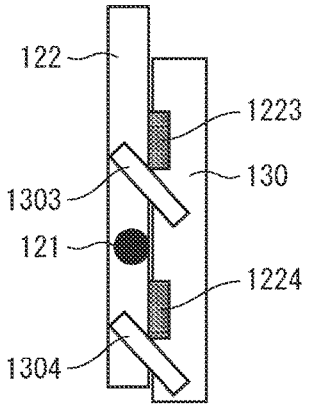
FIG. 19A to FIG. 19C are schematic diagrams illustrating configuration of Modification 2 of a link member push mechanism.
Figure 19B:
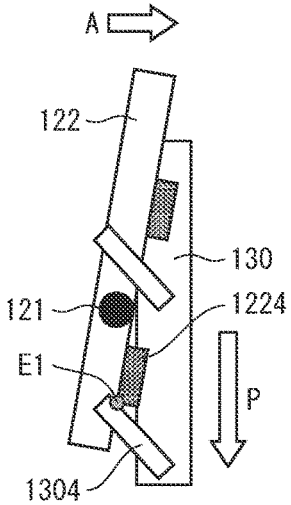
Figure 19C:
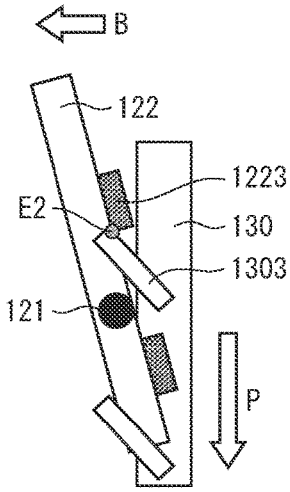

(4-2) FIG. 19A-19C illustrate a second modification of the link member push mechanism.

In FIG. 19A, inclined portions 1303, 1304 are provided on the link member 130, but are angled in a different direction to the inclined portions illustrated in FIGS. 6A-6C. Abutting portions 1223, 1224 that abut against the inclined portions 1303, 1304 are provided on the lever member 122.

According to this configuration, when the lever member 122 is tilted in the direction A, the abutting portions 1224 abuts against the inclined portion 1304 at point E1, and according to taper action the link member 130 moves downwards (direction P) (FIG. 19B). On the other hand, when the lever member 122 is tilted in the direction B, the abutting portions 1223 abuts against the inclined portion 1303 at point E2, and according to taper action the link member 130 moves downwards (direction P) (FIG. 19C).

Figure 20A:
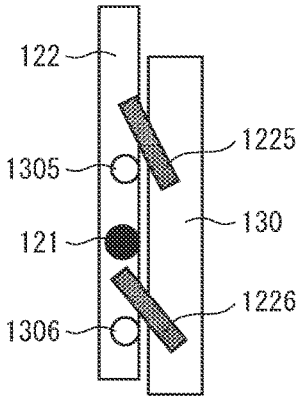
FIG. 20A to FIG. 20C are schematic diagrams illustrating configuration of Modification 3 of a link member push mechanism.
Figure 20B:
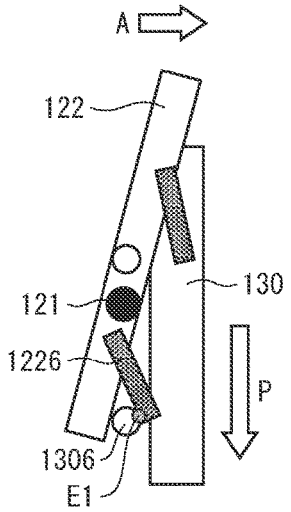
Figure 20C:
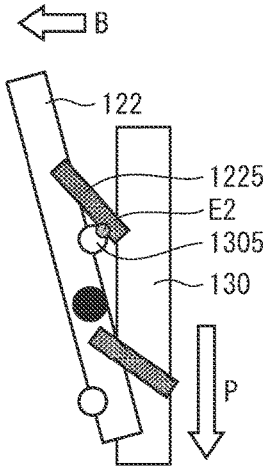

(4-3) FIG. 20A-20C illustrate a third modification of the link member push mechanism.

In FIG. 20A, inclined portions 1225, 1226 are provided on the lever member 122, and pin-shaped abutting portions 1305, 1306 are provided on the link member 130 (the abutting portions 1305, 1306 are held on the link member 130 by a supporting member that is not shown).

When the lever member 122 is tilted in the direction A, the inclined portion 1226 and the abutting portion 1306 contact at point E1, and according to taper action the link member 130 moves downwards (direction P) (FIG. 20B), and when the lever member 122 is tilted in the direction B, the inclined portion 1225 and the abutting portion 1305 contact at point E2, and according to taper action the link member 130 moves downwards (direction P) (FOG 20C).

Figure 21A:
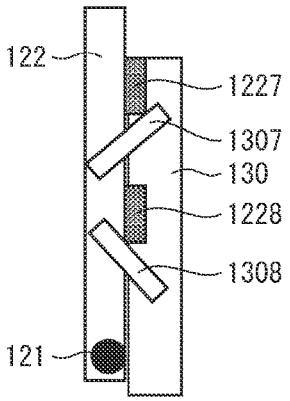
FIG. 21A to FIG. 21C are schematic diagrams illustrating configuration of Modification 4 of a link member push mechanism.
Figure 21B:
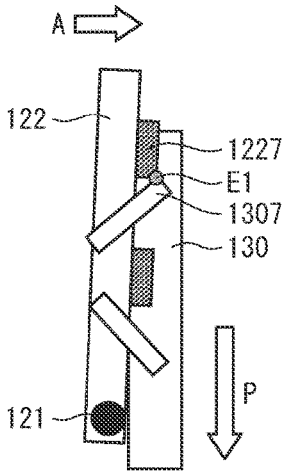
Figure 21C:
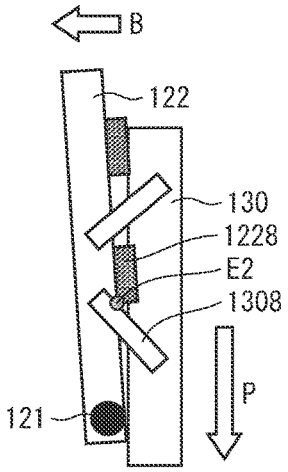

(4-4) FIG. 21A-21C illustrate a fourth modification of the link member push mechanism.

In FIG. 21A, the support axis 121 of the lever member 122 is provided at a lower end of the lever member 122, and inclined portions 1307, 1308 of the link member 130 are angled differently from each other.

According to this configuration, when the lever member 122 is tilted in the direction A, the abutting portion 1227 contacts the inclined portion 1307 at point E1, and according to taper action the link member 130 moves downwards (direction P) (FIG. 21B); when the lever member 122 is tilted in the direction B, the abutting portion 1228 and the inclined portion 1308 contact at point E2, and according to taper action the link member 130 moves downwards (direction P) (FIG. 21C).

(4-5) According to the examples described so far, taking the schematic diagrams of FIGS. 6A-6C as an example, contact portions between the abutting portions 123, 124 and the inclined portions 132, 133 (portions where taper action occurs for an unlocking mechanism) are described as being located in the direction A (first direction) from the support axis 121 of the operation lever 120 at least in a case in which the rear end regulating member 15 is in a lock state, but both contact portions may be in the direction B (second direction) from the support axis 121, making it possible to reduce thickness of the rear end regulating member 15.

Figure 22A:
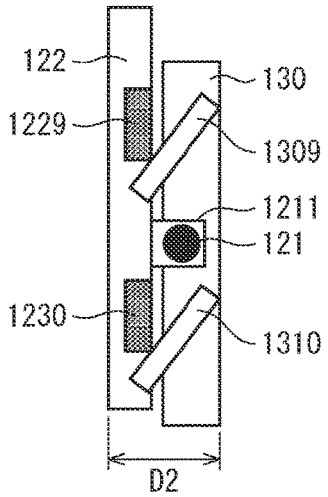
FIG. 22A to FIG. 22C are schematic diagrams illustrating configuration of Modification 5 of a link member push mechanism.
Figure 22B:
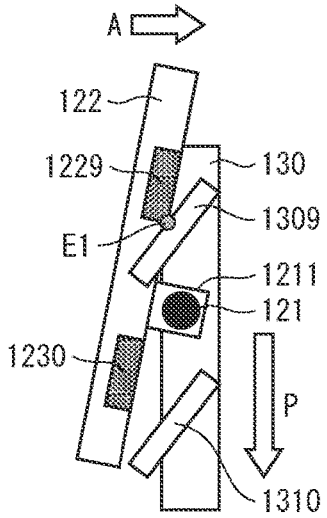
Figure 22C:
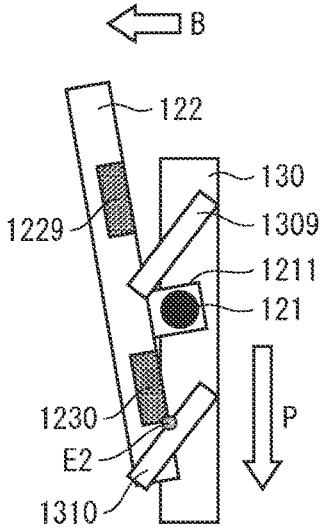

FIG. 22A-22C illustrate a fifth modification of the link member push mechanism.

According to the fifth modification, as illustrated in FIG. 22A, a bearing member 1211 of the lever member 122 protrudes in the direction of the link member 130, and contact portions between abutting portions 1229, 1230 of the lever member 122 and inclined portions 1309, 1310 of the link member 130 are disposed in the direction B (second direction) from the support axis 121.

Even in this configuration, the link member 130 can be moved downwards by taper action when the lever member 122 is tilted in the direction A or B, while reducing thickness of a rear end regulating member as in FIGS. 6A-6C (see FIG. 22B and FIG. 22C).

That is, first and second abutting portions are formed on one side of the lever member 122 or the link member 130, and first and second inclined portions that make contact with the first and second abutting portions and cause a taper action are formed on another side of the lever member 122 or the link member 130, contact portions therebetween (first and second lock release mechanisms) are separated in the longitudinal direction of the lever member 122 and located either in the direction A (first direction) or the direction B (second direction) from the support axis 121 of the lever member 122, and therefore can at least be made thinner than the prototype rear end regulating member illustrated in FIG. 23A-26C.

(5) According to Embodiment 1, taper action is used as a mechanism (movement direction conversion mechanism) for converting downward movement of the link member 130 into movement of the lock members 110 into lock release positions, but the present invention is not limited to this mechanism, and, for example, a publicly-known crank mechanism or the like may be used.

(6) According to at least one embodiment, a configuration is described using compression springs as biasing members that provide forces to bias the lock members 110 towards engagement positions to engage with the notches 16*c*, but the present invention is not limited in this way and another elastic member or the like can be used as a biasing member.

(7) According to at least one embodiment, a configuration is described in which a sheet stacking device is applied to a tandem printer as one example of an image forming device, but the present invention is not limited in this way. The invention can be applied to a sheet stacking device of a photocopier, a facsimile machine, a multi-function peripheral (MFP), or the like as the image forming device.

Further, a configuration is described of the rear end regulating member 15 as a regulating member that regulates sheets stored in the paper cassette 31, but the present invention is not limited in this way and can be applied to the side regulating plates 13, 14, for example. Further, the present invention is not limited to the paper cassette 31, and can be applied to a configuration in which a regulating member is provided to the storage tray 36 in which sheets are stacked after image forming.

Further, the present invention can also be regarded as an invention of the position regulating member itself in a sheet stacking apparatus.

(8) Further, content of any of the embodiments and modifications may be combined where possible.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. A sheet stacking device comprising:

a stacking unit for stacking sheets; and a position regulating member held in the stacking unit and movable in a first direction toward a stacked sheet edge and in a second direction away from the sheet edge, an abutting member of the position regulating member abutting against the sheet edge to regulate position of the sheet, the position regulating member comprising:

a lock member movable between an engage position engaging with an engaging portion of the stacking unit and a release position releasing engagement; and a lock releaser that moves the lock member from the engage position to the release position, the lock releaser comprising:

a lever member, an upper portion of the lever member including an operation portion operable by a user;

a pivot support that supports the lever member and allows the lever member to tilt in the first direction and the second direction;

a first release mechanism cooperating with the lever member when the operation portion of the lever member is tilted in the first direction, in order to move the lock member to the release position; and a second release mechanism cooperating with the lever member when the operation portion of the lever member is tilted in the second direction, in order to move the lock member to the release position, wherein both the first release mechanism and the second release mechanism are provided on the first direction side of the pivot support or on the second direction side of the pivot support, the lock releaser further comprises a movable member movable in a third direction perpendicular to an axis direction of the pivot support and along an abutting surface of the abutting member, the lock releaser converts a force moving the movable member in the third direction to a force moving the lock member to the release position, and the first release mechanism and the second release mechanism move the movable member in the third direction according to a tilt operation moving the operation portion in the first direction or the second direction, respectively, in order to move the lock member to the release position.

2. The sheet stacking device according to claim 1, wherein the lock member is swingably supported on the abutting member to be swingable in a plane perpendicular to the first direction, and is configured to release locking by swinging in a direction away from the engaging portion of the stacking unit, and the lock releaser converts an operation of moving the movable member in the third direction to an operation of swinging the lock member in the direction away from the engaging portion of the stacking unit, in order to release locking.

3. The sheet stacking device according to claim 2, wherein the lever member includes a first engaging portion and a second engaging portion, a distance between the operation portion and the first engaging portion being different from a distance between the operation portion and the second engaging portion, and the movable member includes a first engaged portion that is engaged with the first engaging portion to move the movable member in the third direction when the operation portion is tilted in the first direction and a second engaged portion that is engaged with the second engaging portion to move the movable member in the third direction when the operation portion is tilted in the second direction, and the first release mechanism includes the first engaging portion and the first engaged portion, and the second release mechanism includes the second engaging portion and the second engaged portion.

4. The sheet stacking device according to claim 3, wherein the first engaging portion and the second engaging portion are disposed on opposite sides of the pivot support, the distance between the operation portion and the first engaging portion being shorter than the distance between the operation portion and the second engaging portion.

5. The sheet stacking device according to claim 4, wherein a contact portion between the first engaging portion and the first engaged portion is a first contact portion and a contact portion between the second engaging portion and the second engaged portion is a second contact portion, and a distance between the second contact portion and the pivot support of the lever member is longer than a distance between the first contact portion and the pivot support.

6. The sheet stacking device according to claim 4, wherein a contact portion between the first engaging portion and the first engaged portion is a first contact portion and a contact portion between the second engaging portion and the second engaged portion is a second contact portion, and a distance between the second contact portion and the pivot support of the lever member is shorter than a distance between the first contact portion and the pivot support.

7. The sheet stacking device according to claim 4, wherein at least one of the first engaging portion and the first engaged portion has a first taper surface inclined at an angle away from the third direction, and at least one of the second engaging portion and the second engaged portion has a second taper surface inclined at an angle away from the third direction.

8. The sheet stacking device according to claim 7, wherein the angle of inclination of the second taper surface relative to the third direction is smaller than the angle of inclination of the first taper surface relative to the third direction.

9. The sheet stacking device according to claim 7, wherein the angle of inclination of the second taper surface relative to the third direction is larger than the angle of inclination of the first taper surface relative to the third direction.

10. The sheet stacking device according to claim 1, wherein a biasing unit is provided for biasing the lock member from the lock release position toward the lock position, thereby returning the lock member to the lock position when a user does not operate the operation portion.

11. A sheet stacking device comprising:

a stacking unit for stacking sheets; and a position regulating member held in the stacking unit and movable in a first direction toward a stacked sheet edge and in a second direction away from the sheet edge, an abutting member of the position regulating member abutting against the sheet edge to regulate position of the sheet, the position regulating member comprising:

a lock member movable between an engage position engaging with an engaging portion of the stacking unit and a release position releasing engagement; and a lock releaser that moves the lock member from the engage position to the release position, the lock releaser comprising:

a lever member, an upper portion of the lever member including an operation portion operable by a user;

a pivot support that supports the lever member and allows the lever member to tilt in the first direction and the second direction;

a first release mechanism cooperating with the lever member when the operation portion of the lever member is tilted in the first direction, in order to move the lock member to the release position; and a second release mechanism cooperating with the lever member when the operation portion of the lever member is tilted in the second direction, in order to move the lock member to the release position, wherein both the first release mechanism and the second release mechanism are provided on the first direction side of the pivot support or on the second direction side of the pivot support, the lock member is swingably supported on the abutting member to be swingable in a plane perpendicular to the first direction, according to the first release mechanism, when the operation portion is tilted in the first direction, a first engaging portion of the lever member engages with a first engaged portion of the lock member to move the lock member to the lock release position, and according to the second release mechanism, when the operation portion is tilted in the second direction, a second engaging portion of the lever member that is a different distance from the operation portion than the first engaging member engages with a second engaged portion of the lock member to move the lock member to the lock release position.

12. The sheet stacking device according to claim 11, wherein the first engaging portion and the second engaging portion are disposed on opposite sides of the pivot support, the distance between the operation portion and the first engaging portion being shorter than the distance between the operation portion and the second engaging portion.

13. The sheet stacking device according to claim 12, wherein a contact portion between the first engaging portion and the first engaged portion is a first contact portion and a contact portion between the second engaging portion and the second engaged portion is a second contact portion, and a distance between the second contact portion and the pivot support of the lever member is longer than a distance between the first contact portion and the pivot support.

14. The sheet stacking device according to claim 12, wherein a contact portion between the first engaging portion and the first engaged portion is a first contact portion and a contact portion between the second engaging portion and the second engaged portion is a second contact portion, and a distance between the second contact portion and the pivot support of the lever member is shorter than a distance between the first contact portion and the pivot support.

15. The sheet stacking device according to claim 12, wherein at least one of the first engaging portion and the first engaged portion has a first taper surface inclined at an angle away from the third direction, and at least one of the second engaging portion and the second engaged portion has a second taper surface inclined at an angle away from the third direction.

16. The sheet stacking device according to claim 15, wherein the angle of inclination of the second taper surface relative to the third direction is smaller than the angle of inclination of the first taper surface relative to the third direction.

17. The sheet stacking device according to claim 15, wherein the angle of inclination of the second taper surface relative to the third direction is larger than the angle of inclination of the first taper surface relative to the third direction.

18. A position regulating member held in a stacking unit of a sheet stacking device and movable in a first direction toward a stacked sheet edge and in a second direction away from the sheet edge, an abutting member of the position regulating member abutting against the sheet edge to regulate position of the sheet, the position regulating member comprising:

a lock member movable between an engage position engaging with an engaging portion of the stacking unit and a release position releasing engagement; and a lock releaser that moves the lock member from the engage position to the release position, the lock releaser comprising:

a lever member, an upper portion of the lever member including an operation portion operable by a user;

a pivot support that supports the lever member and allows the lever member to tilt in the first direction and the second direction;

a first release mechanism cooperating with the lever member when the operation portion of the lever member is tilted in the first direction, in order to move the lock member to the release position; and a second release mechanism cooperating with the lever member when the operation portion of the lever member is tilted in the second direction, in order to move the lock member to the release position, wherein both the first release mechanism and the second release mechanism are provided on the first direction side of the pivot support or on the second direction side of the pivot support, the lock releaser further comprises a movable member movable in a third direction perpendicular to an axis direction of the pivot support and along an abutting surface of the abutting member, the lock releaser converts a force moving the movable member in the third direction to a force moving the lock member to the release position, and the first release mechanism and the second release mechanism move the movable member in the third direction according to a tilt operation moving the operation portion in the first direction or the second direction, respectively, in order to move the lock member to the release position.

* * * * *